US010435972B2

(12) United States Patent
Crump et al.

(10) Patent No.: US 10,435,972 B2
(45) Date of Patent: Oct. 8, 2019

(54) WELL PLUG AND BOTTOM HOLE ASSEMBLY

(71) Applicant: Vinson Crump, LLC, Tomball, TX (US)

(72) Inventors: Matthew A. Crump, Tomball, TX (US); Justin P. Vinson, Cypress, TX (US)

(73) Assignee: VINSON CRUMP, LLC, Tomball, TX (US)

( * ) Notice: Subject to any disclaimer, the term of this patent is extended or adjusted under 35 U.S.C. 154(b) by 0 days.

(21) Appl. No.: 15/430,532

(22) Filed: Feb. 12, 2017

(65) Prior Publication Data

US 2018/0230765 A1 Aug. 16, 2018

(51) Int. Cl.
*E21B 23/06* (2006.01)
*E21B 33/12* (2006.01)
*E21B 33/129* (2006.01)

(52) U.S. Cl.
CPC ..... *E21B 23/06* (2013.01); *E21B 33/129* (2013.01)

(58) Field of Classification Search
CPC ..... E21B 23/00; E21B 23/06; E21B 33/00; E21B 33/129; E21B 33/134; E21B 33/1292; E21B 33/1293
See application file for complete search history.

(56) References Cited

U.S. PATENT DOCUMENTS

2009/0277651 A1* 11/2009 Kilgore ..... E21B 33/1208 166/387
2016/0290096 A1* 10/2016 Tse ..... E21B 33/129
2016/0376869 A1* 12/2016 Rochen ..... E21B 23/06 166/135
2017/0260825 A1* 9/2017 Schmidt ..... E21B 23/01

* cited by examiner

*Primary Examiner* — Nicole Coy
*Assistant Examiner* — Dany E Akakpo
(74) *Attorney, Agent, or Firm* — Basil M. Angelo; Angelo IP

(57) ABSTRACT

A bottom hole assembly having a packing element, a lower cone disposed below the packing element, and a lower slip disposed below the packing element. The bottom hole assembly also includes a setting tool removably attached to the plug, the setting tool having a mandrel and a setting sleeve connected to the mandrel. Also, a method for sealing a well including disposing a bottom hole assembly having a plug and a removable setting tool in a well. The method further includes applying pressure to a setting sleeve, contacting an inner diameter of the well with a lower slip, locking the lower slip against an inner diameter of the well, shearing a shear mechanism, disconnecting the removable setting tool from the well, dropping a ball into the well, contacting the ball with the packing element, and separating the well into at least two sections.

17 Claims, 25 Drawing Sheets

WELL PLUG AND BOTTOM HOLE ASSEMBLY

BACKGROUND OF THE INVENTION

Hydrocarbon extraction service providers, including oil and gas companies, have determined that to more effectively produce hydrocarbons from wells, sections of a well may be isolated and the individual sections may be treated and produced separately. One method for isolating sections of a well includes a process referred to in the art as "plug and perf", which refers to the process of isolating a section of a well with a "plug" and subsequently "perforating" a section of the well. This process allows individual sections of the well to be perforated or otherwise treated while keeping the other sections of the well independent. As such, when a first section of a well requires a treatment that is different than a second section of the well, each section of the well may be treated as required rather than providing the same treatment to an entire well.

There are various apparatuses and methods that are used to isolate sections of wells. Frac plugs and bridge plugs are two types of plugs that are used to isolate sections of wells. Currently frac and bridge plugs are inefficient to install and remove, increase the time and costs associated with using such plugs.

BRIEF SUMMARY OF THE INVENTION

According to one aspect of one or more embodiments of the present invention, a bottom hole assembly having a plug including a packing element, a lower conde disposed below the packing element, and a lower slip disposed below the packing element. The bottom hole assembly also includes a setting tool removably attached to the plug, the setting tool having a mandrel and a setting sleeve connected to the mandrel.

According to one aspect of one or more embodiments of the present invention, a plug having a packing element and a lower cone disposed below the packing element, the lower cone having a tapered conical shape on a proximate end forming a ball seat. The plug also includes a lower slip disposed below the packing element and a ball disposed in the ball seat, wherein the ball contacts the packing element.

According to one aspect of one or more embodiments of the present invention. A method for sealing a section of a well, the method including disposing, in a well, a bottom hole assembly having a plug and a removable setting tool, wherein the plug has a packing element, a lower cone, a lower slip, and a shear mechanism and the removable setting tool has a mandrel and a setting sleeve. The method also includes applying pressure to the setting sleeve, contacting an inner diameter of the well with the lower slip as a result of the applying pressure, and locking the lower slip against the inner diameter of the well. The method further includes shearing the shear mechanism, disconnecting the removable setting tool from the plug, removing the removable setting tool from the well, dropping a ball into the well, contacting the ball with the packing element, and separating the well into at least two sections.

Other aspects of the present invention will be apparent from the following description and claims.

DETAILED DESCRIPTION OF THE INVENTION

Figure 1:
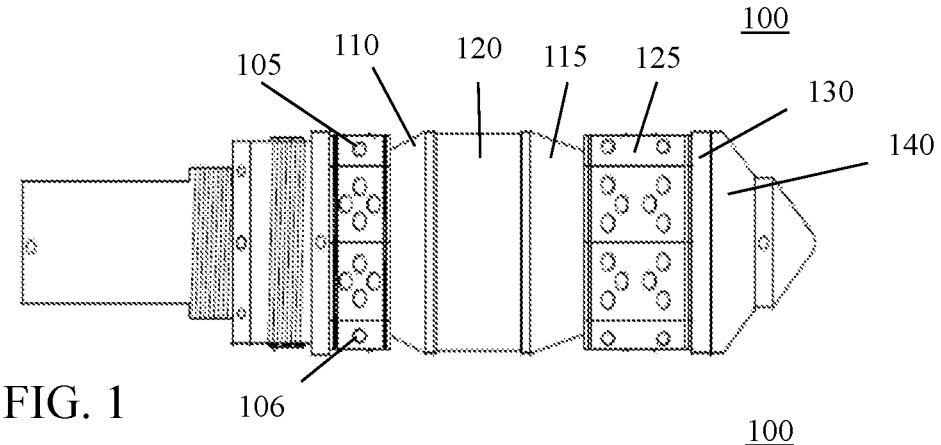
FIG. 1 shows a side perspective view of a plug in accordance with one or more embodiments of the present invention.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are not described to avoid obscuring the description of the present invention.

In typical frac plug and bridge plug design, the plug has a central mandrel that includes a number of components disposed thereon, which are designed to lock the plug in place in order to create a seal. The components may vary depending on the specific design of the plug, but the components conventionally are all designed around the plug mandrel. Plug mandrels include the largest volume of material and are also the most expensive part of the plug. The strength of the mandrel is required because the location of the seal between the mandrel and the inner diameter of the casing and the ball/insert that seals the inner diameter of the mandrel are oriented such that the plug experiences hydraulic pressure that may break or otherwise collapse the mandrel and the associated components. In conventional designs, not having a substantial mandrel may result in tool and/or ultimately well failure.

In order to decrease the cost of frac and bridge plugs, while maintaining the strength of the plug, embodiments of the present invention remove components of the plug that are traditionally left in the well after the plug is set. By placing conventional plug components on the setting tool, components that may be fail points of the plug are removed from the well after setting, thereby only leaving plug components that contribute to the integrity of the plug. Additionally, placing more of the components on the setting tool allows the components to be reused, thereby decreasing the cost of the operation. Still further, by reducing the number of components in the well, drill out operations may be performed more quickly with less expense, thereby increasing the efficiency of well treatment operations.

Embodiments of the present invention generally have two separate components, a plug, which remains in the well after setting and a setting tool, that is removed from the well after setting.

Referring initially to FIG. 1, a side perspective view of a plug according to embodiments of the present disclosure is shown. While the individual components of the plug 100 will be described in detail below, a general overview of the plug 100 is initially provided. In this embodiment, the plug 100 includes an upper slip 105, an upper cone 110, a packing element 120, a lower cone 115, and a lower slip 125. The upper slip 105 is configured to expand radially outward into contact with a well or well casing. The upper cone 110 is configured to engage the upper slip 105, thereby forcing the upper slip 105 into contact with the well or casing. The packing element 120 is configured to create a seal within the well by contacting the inner diameter of the well and additional components disposed within the well, thereby dividing the well into multiple sections. The lower cone 115 is configured to engage the lower slip 125 while the lower slip 125 radially expands into contact with the well or well casing, as described above with respect to the upper slip 105 and upper cone 110.

Plug 100 also includes a lower load ring 130 and a lower guide ring 140. Lower load ring 130 provides that equal setting force is distributed across the lower slip 125. The lower guide ring 140 directs forces encountered during running plug 100 into the well to a shear mechanism (not shown) and not on the lower slip 125, thereby preventing premature actuation of plug 100. Shear mechanism as used herein refers to any frangible material that is configured to break under a specified load or force. Examples of shear mechanisms include shear washers, shear screws, shear rings, or any other breakable material whether made from metals, metal alloys, composites, dissolvable materials, combinations thereof and the like.

In this embodiment, plug 100 includes upper slip 105 that is manufactured out of composite having inserts 106 disposed thereon. Similarly, plug 100 includes lower slip 125 that is manufactured from composite having inserts 106 disposed thereon. The inserts 106 are configured to engage the well or well casing, thereby gripping into the casing holding upper slip 105 and lower slip 125 in place after plug 100 is actuated. The inserts 106 may be glued, brazed, or otherwise attached to upper slip 105 and lower slip 125. Inserts 106 may be formed from various materials including metals, metal alloys, hardening materials, composites, ceramics, and the like. In one embodiment, inserts 106 may be formed from, for example, cast iron or cermet. Those of ordinary skill in the art will appreciate that the number and orientation of inserts 106 may vary according to the operational requirements of the plug.

Figure 2:
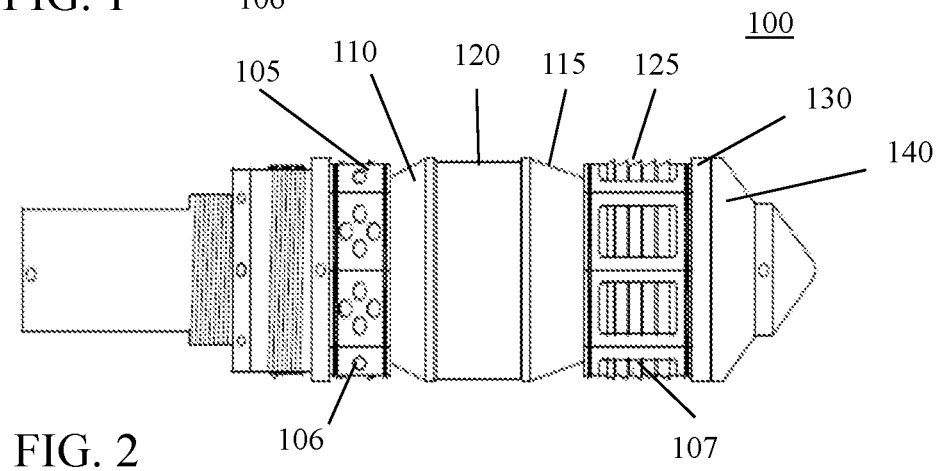
FIG. 2 shows a side perspective view of a plug in accordance with one or more embodiments of the present invention.

Referring initially to FIG. 2, a side perspective view of a plug according to embodiments of the present disclosure is shown. While the individual components of the plug 100 will be described in detail below, a general overview of the plug 100 is initially provided. In this embodiment, the plug 100 includes an upper slip 105, an upper cone 110, a packing element 120, a lower cone 115, and a lower slip 125. The upper slip 105 is configured to expand radially outward into contact with a well or well casing. The upper cone 110 is configured to engage the upper slip 105, thereby forcing the upper slip 105 into contact with the well or casing. The packing element 120 is configured to create a seal within the well by contacting the inner diameter of the well and additional components disposed within the well, thereby dividing the well into multiple section. The lower cone 115 is configured to engage the lower slip 125 while the lower slip 125 radially expands into contact with the well or well casing, as described above with respect to the upper slip 105 and upper cone 110.

Plug 100 also includes a lower load ring 130 and a lower guide ring 140. Lower load ring 130 provides equal setting force is distributed across the lower slip 125. The lower guide ring 140 directs forces encountered during running plug 100 into the well to a shear mechanism (not shown) and not on the lower slip 125, thereby preventing premature actuation of plug 100.

In this embodiment, plug 100 includes upper slip 105 that is manufactured out of composite having inserts 106 disposed thereon. The inserts 106 are configured to engage the well or well casing, thereby gripping into the casing holding upper slip 105 and lower slip 125 in place after plug 100 is actuated. The inserts 106 may be glued, brazed, or otherwise attached to upper slip 105 and lower slip 125. Inserts 106 may be formed from various materials including metals, metal alloys, hardening materials, composites, ceramics, and the like. In one embodiment, inserts 106 may be formed from, for example, cast iron or cermet. Those of ordinary skill in the art will appreciate that the number and orientation of inserts 106 may vary according to the operational requirements of the plug. Plug 100 also includes lower slip 125 that is manufactured from a composite having wicker inserts 107 disposed or otherwise formed thereon. The wicker inserts 107 are designed to engage and grip the inner diameter of the well or well casing, as described above with respect to inserts 106. Wicker inserts 107, as used herein, refers to thin pads or strips of metal having a wicker design that are installed on or formed with the composite structure of lower slip 125. Those of ordinary skill in the art will appreciate that the number, orientation, and spacing of wicker inserts 107 may vary according to the operational requirements of the plug.

Figure 3:
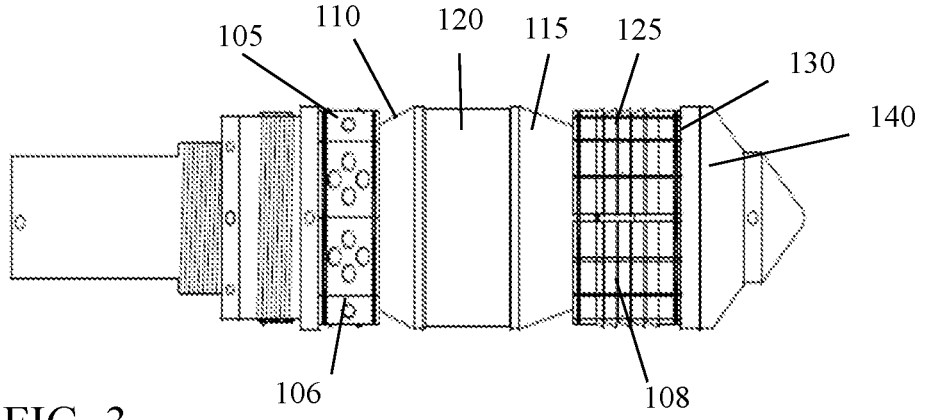
FIG. 3 shows a side perspective view of a plug in accordance with one or more embodiments of the present invention.

Referring initially to FIG. 3, a side perspective view of a plug according to embodiments of the present disclosure is shown. While the individual components of the plug 100 will be described in detail below, a general overview of the plug 100 is initially provided. In this embodiment, the plug 100 includes an upper slip 105, an upper cone 110, a packing element 120, a lower cone 115, and a lower slip 125. The upper slip 105 is configured to expand radially outward into contact with a well or well casing. The upper cone 110 is configured to engage the upper slip 105, thereby forcing the upper slip 105 into contact with the well or casing. The packing element 120 is configured to create a seal within the well by contacting the inner diameter of the well and additional components disposed within the well, thereby dividing the well into multiple section. The lower cone 115 is configured to engage the lower slip 125 while the lower slip 125 radially expands into contact with the well or well casing, as described above with respect to the upper slip 105 and upper cone 110.

Plug 100 also includes a lower load ring 130 and a lower guide ring 140. Lower load ring 130 provides equal setting force is distributed across the lower slip 125. The lower guide ring 140 directs forces encountered during running plug 100 into the well to a shear mechanism (not shown) and not on the lower slip 125, thereby preventing premature actuation of plug 100.

In this embodiment, plug 100 includes upper slip 105 that is manufactured out of composite having inserts 106 disposed thereon. The inserts 106 are configured to engage the well or well casing, thereby gripping into the casing holding upper slip 105 and lower slip 125 in place after plug 100 is actuated. The inserts 106 may be glued, brazed, or otherwise attached to upper slip 105 and lower slip 125. Inserts 106 may be formed from various materials including metals, metal alloys, hardening materials, composites, ceramics, and the like. In one embodiment, inserts 106 may be formed from, for example, cast iron or cermet. Those of ordinary skill in the art will appreciate that the number and orientation of inserts 106 may vary according to the operational requirements of the plug. Plug 100 also includes lower slip 125 that is manufactured from cast iron having gripping structure 108 disposed or otherwise formed thereon. The griping structure 108 is designed to engage and grip the inner diameter of the well or well casing, as described above with respect to inserts 106. Gripping structure 108 may include teeth, raised portions, buttons, or any other structure that is capable of holding lower slip 125 against the casing of a well. Those of ordinary skill in the art will appreciate that the number, orientation, and spacing of gripping structure 108 may vary according to the operational requirements of the plug.

Figure 4:
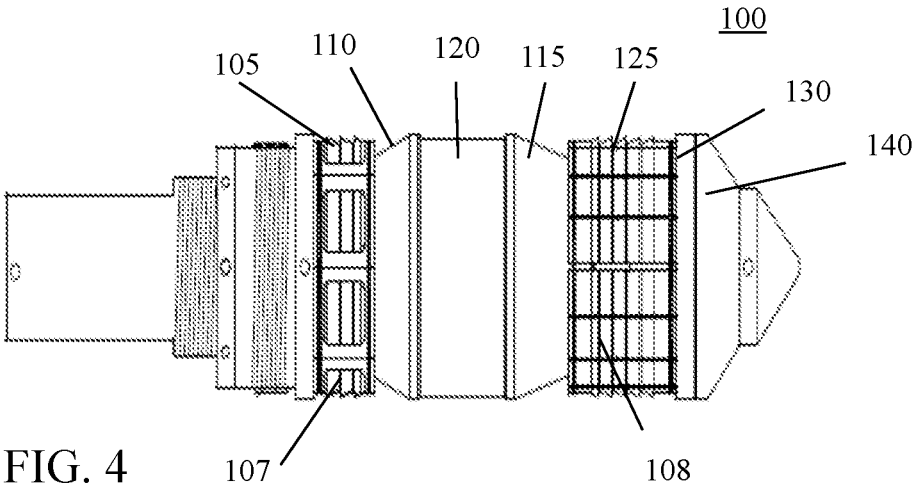
FIG. 4 shows a side perspective view of a plug in accordance with one or more embodiments of the present invention.

Referring initially to FIG. 4, a side perspective view of a plug according to embodiments of the present disclosure is shown. While the individual components of the plug 100 will be described in detail below, a general overview of the plug 100 is initially provided. In this embodiment, the plug 100 includes an upper slip 105, an upper cone 110, a packing element 120, a lower cone 115, and a lower slip 125. The upper slip 105 is configured to expand radially outward into contact with a well or well casing. The upper cone 110 is configured to engage the upper slip 105, thereby forcing the upper slip 105 into contact with the well or casing. The packing element 120 is configured to create a seal within the well by contacting the inner diameter of the well and additional components disposed within the well, thereby dividing the well into multiple section. The lower cone 115 is configured to engage the lower slip 125 while the lower slip 125 radially expands into contact with the well or well casing, as described above with respect to the upper slip 105 and upper cone 110.

Plug 100 also includes a lower load ring 130 and a lower guide ring 140. Lower load ring 130 provides equal setting force is distributed across the lower slip 125. The lower guide ring 140 directs forces encountered during running plug 100 into the well to a shear mechanism (not shown) and not on the lower slip 125, thereby preventing premature actuation of plug 100.

In this embodiment, plug 100 includes upper slip 105 that is manufactured out of composites having wicker inserts 107 disposed or otherwise formed thereon. The wicker inserts 107 are designed to engage and grip the inner diameter of the well or well casing, as described above with respect to inserts 106. Those of ordinary skill in the art will appreciate that the number, orientation, and spacing of wicker inserts 107 may vary according to the operational requirements of the plug. Plug 100 also includes lower slip 125 that is manufactured from cast iron having gripping structure 108 disposed or otherwise formed thereon. The griping structure 108 is designed to engage and grip the inner diameter of the well or well casing, as described above with respect to inserts 106. Gripping structure 108 may include teeth, raised portions, buttons, or any other structure that is capable of holding lower slip 125 against the casing of a well. Those of ordinary skill in the art will appreciate that the number, orientation, and spacing of gripping structure 108 may vary according to the operational requirements of the plug.

Figure 5:
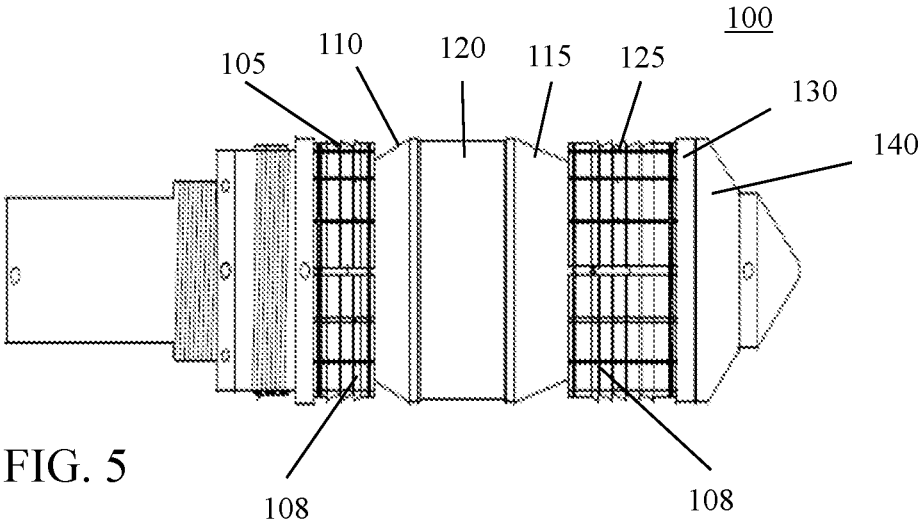
FIG. 5 shows a side perspective view of a plug in accordance with one or more embodiments of the present invention.

Referring initially to FIG. 5, a side perspective view of a plug according to embodiments of the present disclosure is shown. While the individual components of the plug 100 will be described in detail below, a general overview of the plug 100 is initially provided. In this embodiment, the plug 100 includes an upper slip 105, an upper cone 110, a packing element 120, a lower cone 115, and a lower slip 125. The upper slip 105 is configured to expand radially outward into contact with a well or well casing. The upper cone 110 is configured to engage the upper slip 105, thereby forcing the upper slip 105 into contact with the well or casing. The packing element 120 is configured to create a seal within the well by contacting the inner diameter of the well and additional components disposed within the well, thereby dividing the well into multiple section. The lower cone 115 is configured to engage the lower slip 125 while the lower slip 125 radially expands into contact with the well or well casing, as described above with respect to the upper slip 105 and upper cone 110.

Plug 100 also includes a lower load ring 130 and a lower guide ring 140. Lower load ring 130 provides equal setting force is distributed across the lower slip 125. The lower guide ring 140 directs forces encountered during running plug 100 into the well to a shear mechanism (not shown) and not on the lower slip 125, thereby preventing premature actuation of plug 100.

In this embodiment, plug 100 includes both an upper slip 105 and a lower slip 125 that are manufactured from cast iron having gripping structure 108 disposed or otherwise formed thereon. The griping structure 108 is designed to engage and grip the inner diameter of the well or well casing, as described above with respect to inserts 106. Gripping structure 108 may include teeth, raised portions, buttons, or any other structure that is capable of holding lower slip 125 against the casing of a well. Those of ordinary skill in the art will appreciate that the number, orientation, and spacing of gripping structure 108 may vary according to the operational requirements of the plug.

Those of ordinary skill in the art will appreciate that the description above of plugs 100, as well as the formation of upper slips 105 and lower slips 125 are merely exemplary of the various configurations that may be used according to embodiments of the present invention. As such, other configurations may be used, as well as other materials, in order to manufacture or otherwise form upper slips 105 and slower slips 125. Examples of variations in the types of materials that may be used to manufacture components of the plugs described above include metals, metal alloys, composites, dissolvable materials, combinations thereof, and the like.

Figure 6:
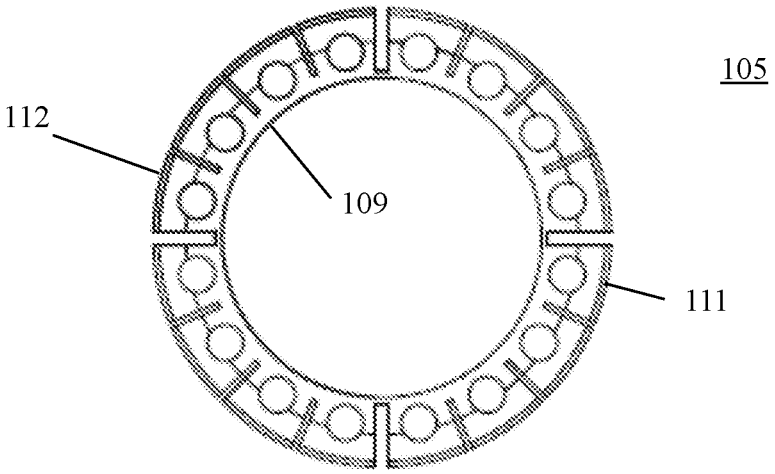
FIG. 6 shows a cross-sectional view of an upper slip in accordance with one or more embodiments of the present invention.
Figure 7:
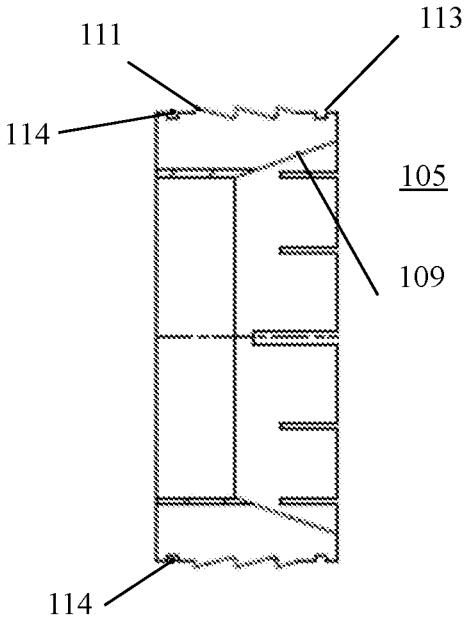
FIG. 7 shows a cross-sectional view of an upper slip in accordance with one or more embodiments of the present invention.

Referring to FIGS. 6 and 7, a cross-sectional top view of an upper slip 105 and a cross-sectional side view of the upper slip 105, respectively, according to embodiments of the present invention are shown. Upper slip 105 is configured to radially expand into and engage the inner diameter of a well or well casing (not shown). The upper slip 105 forms the top of the plug and is installed on the mandrel of the setting tool (not shown) just below a setting ring (not shown). Upper slip 105 may include a tapered inner surface 109 and may have a hardened outer surface 111. The tapered inner surface 109 is configured to engage a tapered outer surface of the upper cone (110 of FIG. 1), so that when engaged, upper slip 105 expands toward the inner diameter of the well or well casing and the hardened outer surface 111 of upper slip 105 engages into the well or well casing, thereby locking upper slip 105 and upper cone (110 of FIG. 1) into place.

Upper slip 105 may be formed as a solid ring of a material that breaks under a certain pressure. For example, upper slip 105 may be formed from metals, such as iron, composites, or various combinations thereof. Upper slip 105 may also be formed as a series of segments 112 that are held together and designed to separate when a certain pressure is applied.

Upper slip 105 may also include one or more channels 113 disposed above and/or below hardened surface 111 so that one or more bands 114 may be disposed therein. The bands 114 may be used to increase the strength of upper slip 105, thereby increasing the pressure or force required to break upper slip 105.

Those of ordinary skill in the art will appreciate that various other aspects of upper slip 105 may be included in upper slip 105 design, which are not explicitly disclosed herein. The design and materials discussed above are provided as examples of upper slip design 105 and are not meant to limit the scope of the disclosure.

Figure 8:
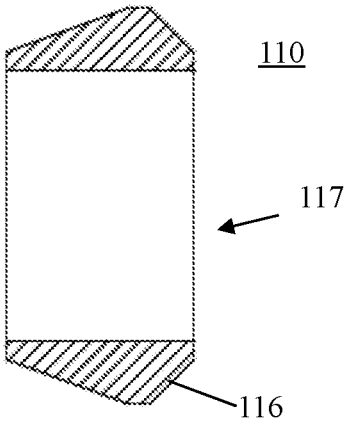
FIG. 8 shows a side perspective view of a upper cone in accordance with one or more embodiments of the present invention.

Referring to FIG. 8, a side perspective view of an upper cone 110 according to embodiments of the present invention is shown. Upper cone 110 may have a conical shape 116 on the distal end 117 that engage and/or mates with a top edge of a packing element (120 of FIG. 1). The conical shape 116 allows the packing element (120 of FIG. 1) to ramp up upper cone 110 toward the inner diameter of the well or well casing. In certain embodiments, upper cone 110 may include a mechanical lock (not shown) disposed on the inner diameter thereof that allows a ball to pass through upper cone 110 and remain locked in place after passing therethrough. Mechanical lock, as used herein, refers to any mechanical attachment that allows the one-way movement of a ball. Examples of mechanical locks include, lock rings, dogs, dogs and slips, rod locks, and the like.

During actuation, the tapered outer surface of upper cone 110 is configured to engage the tapered inner surface of upper slip (105 of FIGS. 6 and 7). As described above, as the outer surface of upper cone 110 pushes against the inner surface of upper slip (105 of FIGS. 6 and 7), thereby forcing upper slip (105 of FIGS. 6 and 7) into contact with the well or well casing. When upper cone 110 is locked into place by upper slip (105 of FIGS. 6 and 7), the packing element (120 of FIG. 1) may energize by expanding into contact with the well or well casing.

Upper cone 110 may be manufactured or formed from various materials including metals, metal alloys, composites, and combinations thereof. Those of ordinary skill in the art will appreciate that various other aspects of upper cone 110 may be included in upper cone 110 design, which are not explicitly disclosed herein. For example, various cone angles, finishing materials, tapered outer diameter surfaces, etc., may be included as design aspects of upper cone 110. The design and materials discussed above are provided as examples of upper cone 110 design and are not meant to limit the scope of the disclosure.

Figure 9:
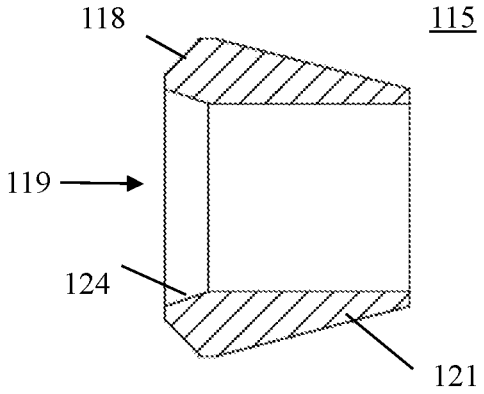
FIG. 9 shows a side perspective view of a lower cone in accordance with one or more embodiments of the present invention.

Referring to FIG. 9, a side perspective view of a lower cone 115 according to embodiments of the present invention is shown. Lower cone 115 may have a tapered shape 118 on the proximate end 119 that engages and/or mates with a bottom edge of a packing element (120 of FIG. 1). Lower cone 115 may also have a tapered cone shape 121 on the distal outer diameter that is configured to engage the lower slip (125 of FIG. 1). Additionally, lower cone 115 may have a tapered conical shape 124 on the proximate 118 inner diameter that effectively creates a seat, or landing area, for a ball (not shown) to land. The tapered conical shape 124 may include both linear and arcuate designs configured to receive a ball (not shown).

During actuation, the outer surface, tapered cone shape 121, of lower cone 115 is configured to engage the inner surface of lower slip (125 of FIG. 1). As the outer surface of lower cone 115 pushes against the inner surface of lower slip (125 of FIG. 1), lower slip (125 of FIG. 1) is forced into contact with the well or well casing. When lower cone 115 is locked into place by lower slip (125 of FIG. 1), the packing element (120 of FIG. 1) may energize by expanding into contact with the well or well casing.

In certain embodiments, lower cone 115 has an inner diameter that is smaller than the inner diameter of upper cone (110 of FIG. 8). Because the inner diameter of lower cone 115 is smaller than the inner diameter of upper cone (110 of FIG. 8) a ball (not shown) may pass through the upper slip (105 of FIGS. 6 and 7) and upper cone (110 of FIG. 8) and land on a seat created by the inner diameter of lower cone 115. Because lower cone 115 is thicker, it may also better resist the forces generated during treatment operations.

Lower cone 115 may be manufactured or formed from various materials including metals, metal alloys, composites, and combinations thereof. Those of ordinary skill in the art will appreciate that various other aspects of lower cone 115 may be included in lower cone 115 design, which are not explicitly disclosed herein. For example, various cone angles, finishing materials, tapered outer diameter surfaces, etc., may be included as design aspects of lower cone 115. The design and materials discussed above are provided as examples of lower cone 115 design and are not meant to limit the scope of the disclosure.

Figure 10:
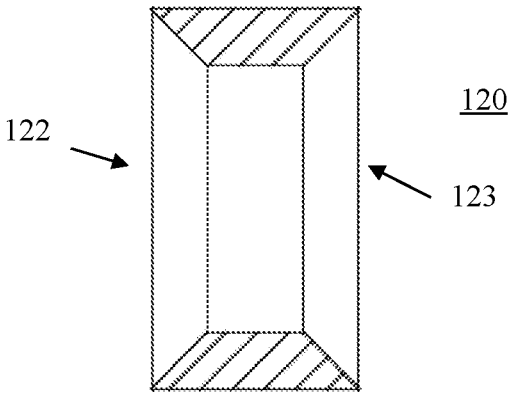
FIG. 10 shows a side perspective view of a packing element in accordance with one or more embodiments of the present invention.

Referring to FIG. 10, a side perspective view of a packing element 120 according to embodiments of the present invention is shown. Packing element 120 is formed from an elastomeric material designed to create a seal between the inner diameter of the well or well casing and the upper and lower cones (110 and 115 of FIGS. 8 and 9, respectively), and a ball (not shown) that is configured to land on a ball seat created by the lower cone (115 of FIG. 9). Packing element 120 may include a tapered shape on both a proximate end 122 and a distal end 123 to engage upper cone (110 of FIG. 8) and lower cone (115 of FIG. 9), respectively. When upper and lower cones (110 and 115 of FIGS. 8 and 9, respectively) are forced together, packing element 120 is forced outward into contact with the inner diameter of the well or well casing. Under the full setting load, the elastomeric material of packing element 120 may extrude upwardly into the gap between the upper cone (110 of FIG. 8) and the well or well casing inner diameter, downwardly into the gap between the lower cone (115 of FIG. 9) and the well or well casing inner diameter, and inwardly into the gap between the upper and lower cones (110 and 115 of FIGS. 8 and 9, respectively) that is formed after setting. The inward extrusion of packing element 120 may thereby engage a ball (not shown) that is landed on a ball seat created by lower cone (115 of FIG. 9). The engagement of the ball (not shown) will provide for a seal between the inner diameter of the plug 100 and the ball (not shown), as well as further energize packing element 120 to seal the inner diameter of the well or well casing.

Those of ordinary skill in the art will appreciate that other design aspects of packing element 120 may be included, which are not explicitly disclosed above. For example, various types of elastomeric materials, such as rubber, may be used to form packing element 120. Additionally, packing element 120 may include other design aspects known to those of ordinary skill in the art.

Figure 11:
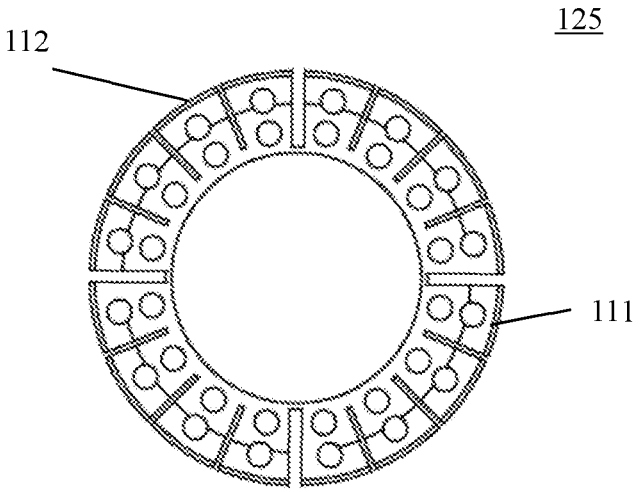
FIG. 11 shows a cross-sectional view of a lower slip in accordance with one or more embodiments of the present invention.
Figure 12:
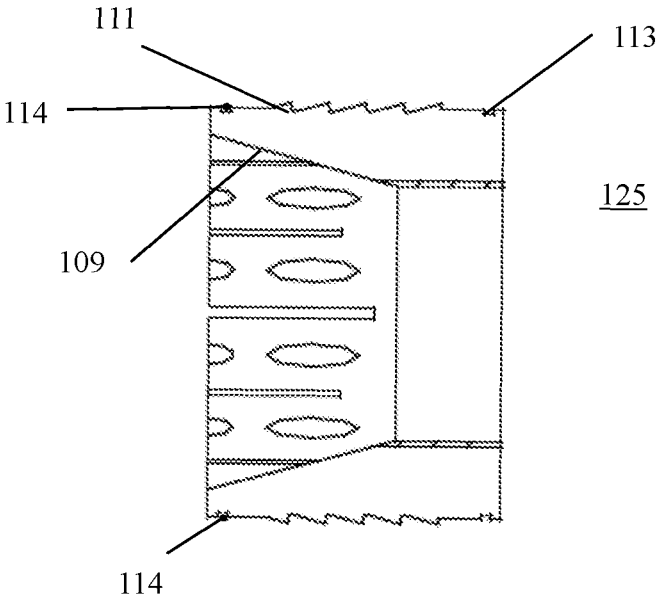
FIG. 12 shows a cross-sectional view of a lower slip in accordance with one or more embodiments of the present invention.

Referring to FIGS. 11 and 12, a cross-sectional top view of a lower slip 125 and a cross-sectional side view of the lower slip 125, respectively, according to embodiments of the present invention are shown. Lower slip 125 is configured to radially expand into and engage the inner diameter of a well or well casing (not shown). The lower slip 125 forms the bottom of the plug. Lower slip 125 may include a tapered inner surface 109 and may have a hardened outer surface 111. The tapered inner surface 109 is configured to engage a tapered outer surface of the lower cone (115 of FIG. 1), so that when engaged, lower slip 125 expands toward the inner diameter of the well or well casing and the hardened outer surface 111 of lower slip 125 engages into the well or well casing, thereby locking lower slip 125 and lower cone (115 of FIG. 1) into place.

Lower slip 125 may be formed as a solid ring of a material that breaks under a certain pressure. For example, lower slip 125 may be formed from metals, such as iron, composites, or various combinations thereof. Lower slip 125 may also be formed as a series of segments 112 that are held together and designed to separate when a certain pressure is applied.

Lower slip 125 may also include one or more channels 113 disposed above and/or below hardened surface 111 so that one or more bands 114 may be disposed therein. The bands 114 may be used to increase the strength of lower slip 125, thereby increasing the pressure or force required to break lower slip 125.

Those of ordinary skill in the art will appreciate that various other aspects of lower slip 125 may be included in lower slip 125 design, which are not explicitly disclosed herein. The design and materials discussed above are provided as examples of lower slip 125 design and are not meant to limit the scope of the disclosure.

Figure 13:
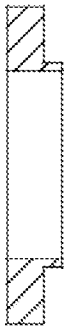
FIG. 13 shows a side perspective view of a lower load ring in accordance with one or more embodiments of the present invention.

Referring to FIG. 13, a side perspective view of a lower load ring 130 according to embodiments of the present invention is shown. Lower load ring 130 provides that equal setting force is distributed across the lower slip (125 of FIGS. 11 and 12). Said another way, lower load ring 130 abuts lower slip (125 of FIGS. 11 and 12), thereby distributing forces applied thereto equally. Lower load ring 130 may be manufactured or formed from various materials including metals, metal alloys, composites, and combinations thereof.

Figure 14:
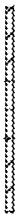
FIG. 14 shows a side perspective view of a shear mechanism in accordance with one or more embodiments of the present invention.
Figure 20:
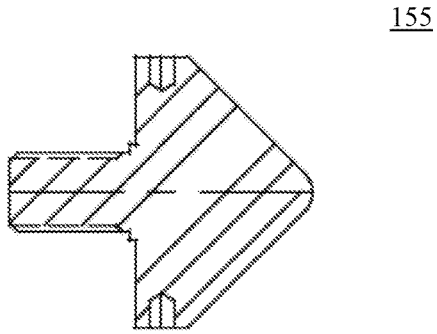
FIG. 20 shows a side perspective view of a WLAK nose in accordance with one or more embodiments of the present invention.

Referring to FIG. 14, a side perspective view of a shear mechanism 135 according to embodiments of the present invention is shown. Shear mechanism 135 is designed to shear, or break, at a specified setting force, which allows plug 100 to set at the specified force, further allowing the mandrel (now shown) to shear away from plug 100. The inner diameter of shear mechanism 135 may be smaller than the inner diameter of lower load ring (130 of FIG. 13), as well as guide ring (140 of FIG. 1), thereby allowing the shear mechanism 135 alone to engage the mandrel (not shown) and a shear mechanism lock nose (FIG. 20).

Figure 15:
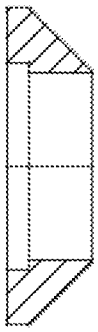
FIG. 15 shows a side perspective view of a guide ring in accordance with one or more embodiments of the present invention.

Referring to FIG. 15, a side perspective view of a guide ring 140 according to embodiments of the present invention is shown. Lower guide ring 140 directs forces encountered during running plug 100 into the well to the shear mechanism (135 of FIG. 14) and not on the lower slip 125, thereby preventing premature actuation of plug 100.

Figure 16:
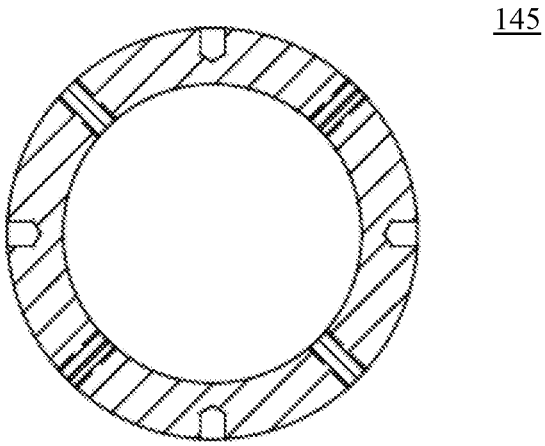
FIG. 16 shows a cross-sectional view of a WLAK lock nut in accordance with one or more embodiments of the present invention.
Figure 17:
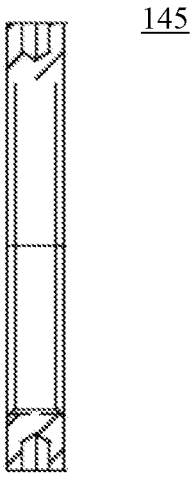
FIG. 17 shows a side perspective view of a WLAK lick nut in accordance with one or more embodiments of the present invention.

Referring to FIGS. 16 and 17, a cross-sectional view and a side perspective view of a WLAK lock nut 145, respectively, according to embodiments of the present invention are shown. As used herein, WLAK refers to a wireline adapter kit, or a wireline actuation/setting tool. As such, the WLAK lock nut 145 may be referred to as a lock nut, a wireline lock nut, or a WLAK lock nut and their meanings are the same as used herein. The WLAK lock nut 145 is configured to engage with threads on the outer diameter of the proximate end of the mandrel (not shown). As such, WLAK lock nut 145 is designed to apply pressure on plug (100 of FIG. 1) through a WLAK upper load ring, discussed below. The pressure applied thereto prevents components from rattling or otherwise moving in an undesirable manner during run in. Specifics of the operation of this component will be discussed in detail below.

Figure 18:
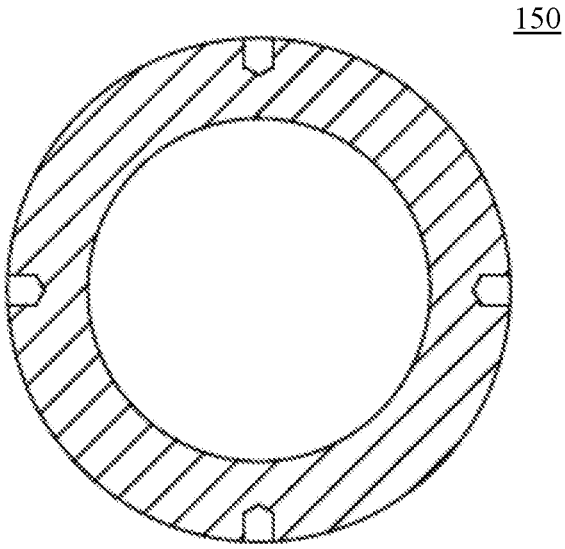
FIG. 18 shows a cross-sectional view of an upper load ring in accordance with one or more embodiments of the present invention.
Figure 19:
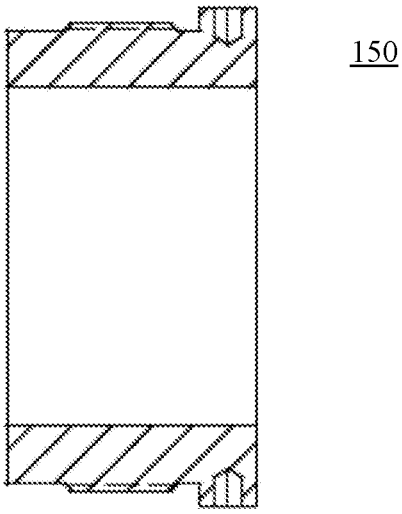
FIG. 19 shows a cross-sectional view of an upper load ring in accordance with one or more embodiments of the present invention.

Referring to FIGS. 18 and 19, a cross-sectional view and a side perspective view of a WLAK upper load ring 150, respectively, according to embodiments of the present invention are shown. As discussed above, WLAK refers to a wireline adapter kit, or a wireline actuation/setting tool. As such, the WLAK upper load ring 150 may be referred to as an upper load ring, a load ring, or a WLAK load ring and their meanings are the same as used herein. The WLAK upper load ring 150 extends from the outer diameter of the mandrel (not shown) to the outer diameter of the setting sleeve (not shown). The WLAK upper load ring 150 provides for an equal distribution of setting force across the proximate end of upper slip (105 of FIG. 1). WLAK upper load ring 150 includes outer diameter threads that engage with threads on the inner diameter of the WLAK setting sleeve (not shown). Specifics of the operation of this component will be discussed in detail below.

Referring to FIG. 20, a side perspective view of a WLAK nose 155 according to embodiments of the present invention is shown. As discussed above, WLAK refers to a wireline adapter kit, or a wireline actuation/setting tool. As such, the WLAK nose 155 may be referred to as a nose, a wireline nose, or a WLAK nose and their meanings are the same as used herein. The WLAK nose 155 has outer diameter threads that thread on to the inner diameter of the mandrel (not shown). The shear mechanism (135 of FIG. 14) is placed between the mandrel (not shown) and the WLAK nose 155. The distal edge of the WLAK nose 155 provides a conical shape for guiding the bottom hole assembly into the well.

Figure 21:
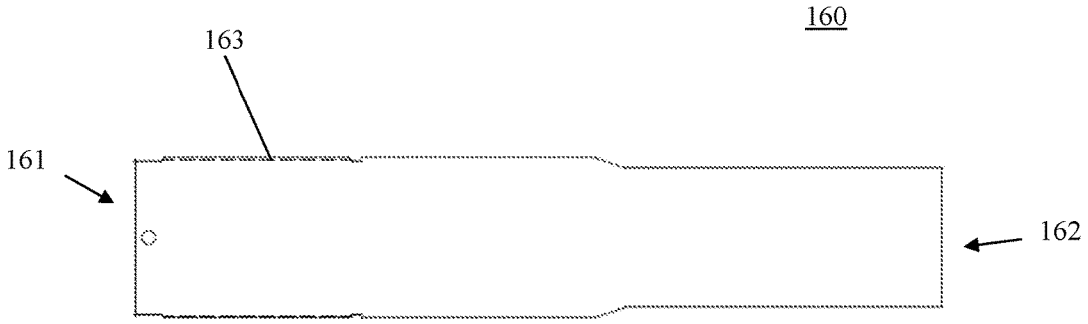
FIG. 21 shows a side perspective view of a WLAK mandrel in accordance with one or more embodiments of the present invention.

Referring to FIG. 21, a side perspective view of a WLAK mandrel 160 according to embodiments of the present invention is shown. As discussed above, WLAK refers to a wireline adapter kit, or a wireline actuation/setting tool. As such, the WLAK mandrel 160 may be referred to as a mandrel, a wireline mandrel, or a WLAK mandrel and their meanings are the same as used herein. The WLAK mandrel 160 is the central component of the bottom hole assembly during run in and setting operations. WLAK mandrel 160 may have a larger outer diameter on a proximate end 161 and a smaller outer diameter on the distal end 162. The proximate end 161 of WLAK mandrel 160 includes inner threads (not shown) that allow the setting tool to connect to WLAK mandrel 160. The threads 163 may also be used to engage the WLAK lock nut (145 of FIGS. 16 and 17). The distal end 162 of WLAK mandrel 160 also has inner diameter threads (not shown) that allow the connection of the shear mechanism (135 of FIG. 14) and WLAK nose (155 of FIG. 20).

WLAK mandrel 160 includes an outer diameter transition from a larger outer diameter at the proximate end 161 to a smaller outer diameter at the distal end 162 that coincides with the ball seat created by the lower cone (115 of FIG. 1). WLAK mandrel 160 may also be reusable because it is a component of the setting device rather than an integral piece of the plug (100 of FIG. 1).

Figure 22:
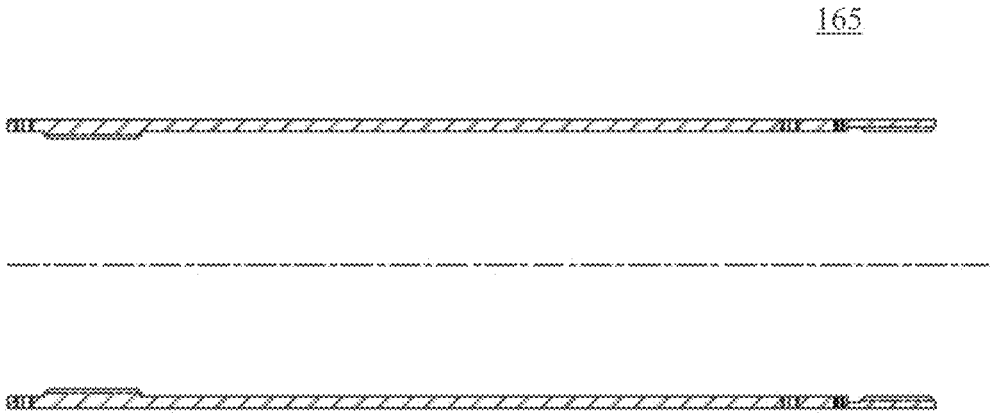
FIG. 22 shows a cross-sectional view of a WLAK setting sleeve in accordance with one or more embodiments of the present invention.
Figure 23:
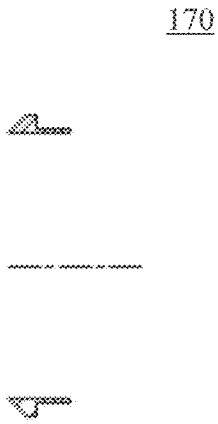
FIG. 23 shows a cross-sectional view of a WLAK guide ring in accordance with one or more embodiments of the present invention.
Figure 24:
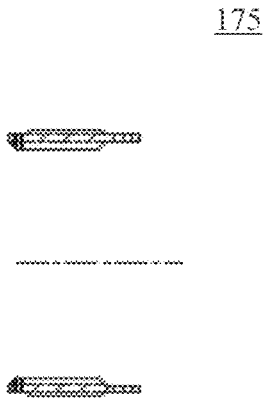
FIG. 24 shows a cross-sectional view of a WLAK adjuster nut in accordance with one or more embodiments of the present invention.

Referring to FIGS. 22, 23, and 24, a cross-sectional view of a WLAK setting sleeve 165, a cross-sectional view of a WLAK guide ring 170, and a cross-sectional view of a WLAK adjuster nut 175, respectively, according to embodiments of the present invention are shown. The WLAK setting sleeve 165 (or setting sleeve) has internal threads that engage the outer threads of the WLAK adjuster nut 175. The WLAK guide ring 170 (or guide ring) provides a conical shape to allow the setting tool and the WLAK setting sleeve 165 (or setting sleeve) to pass through restrictions as it is removed from a well. The WLAK adjuster nut 175 (or adjuster nut) has internal threads that connect the WLAK adjuster nut 175 to a setting tool (not shown) and outer threads that allow the adjuster nut 175 to connect to the WLAK setting sleeve.

Figure 25:
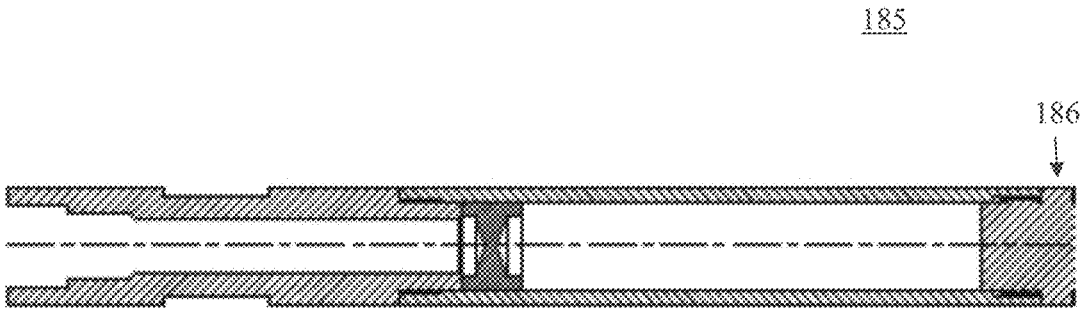
FIG. 25 shows a cross-sectional view of a setting tool in accordance with one or more embodiments of the present invention.
Figure 26:
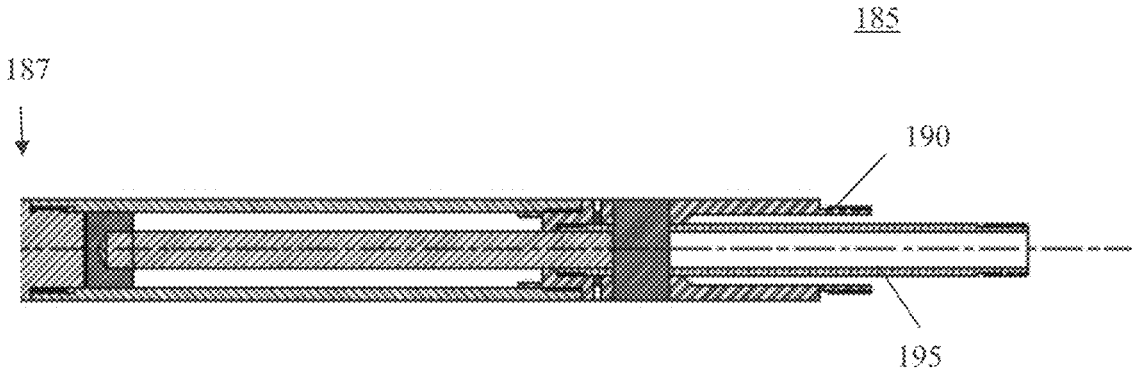
FIG. 26 shows a cross-sectional view of a setting tool in accordance with one or more embodiments of the present invention.

Referring to FIGS. 25 and 26 together, cross-sectional views of a setting tool 185 according to embodiments of the present invention is shown. For clarity, FIGS. 25 and 26 together form a single setting tool 185, with the distal end 186 of FIG. 25 connecting with the proximate end 187 of FIG. 26. Setting tool 185 includes a setting tool setting mandrel 195 and a setting tool cross link sleeve 190. The setting tool cross link sleeve 190 threadably connects to the WLAK adjuster nut (175 of FIG. 24), thus allowing the setting tool 185 to connect to the WLAK setting sleeve (165 of FIG. 22). Additionally, WLAK mandrel 160 has internal threads that connect to the external threads of setting tool setting mandrel 195. The setting tool may be run in hole and used to actuate the plug (100 of FIG. 1).

Figure 27:
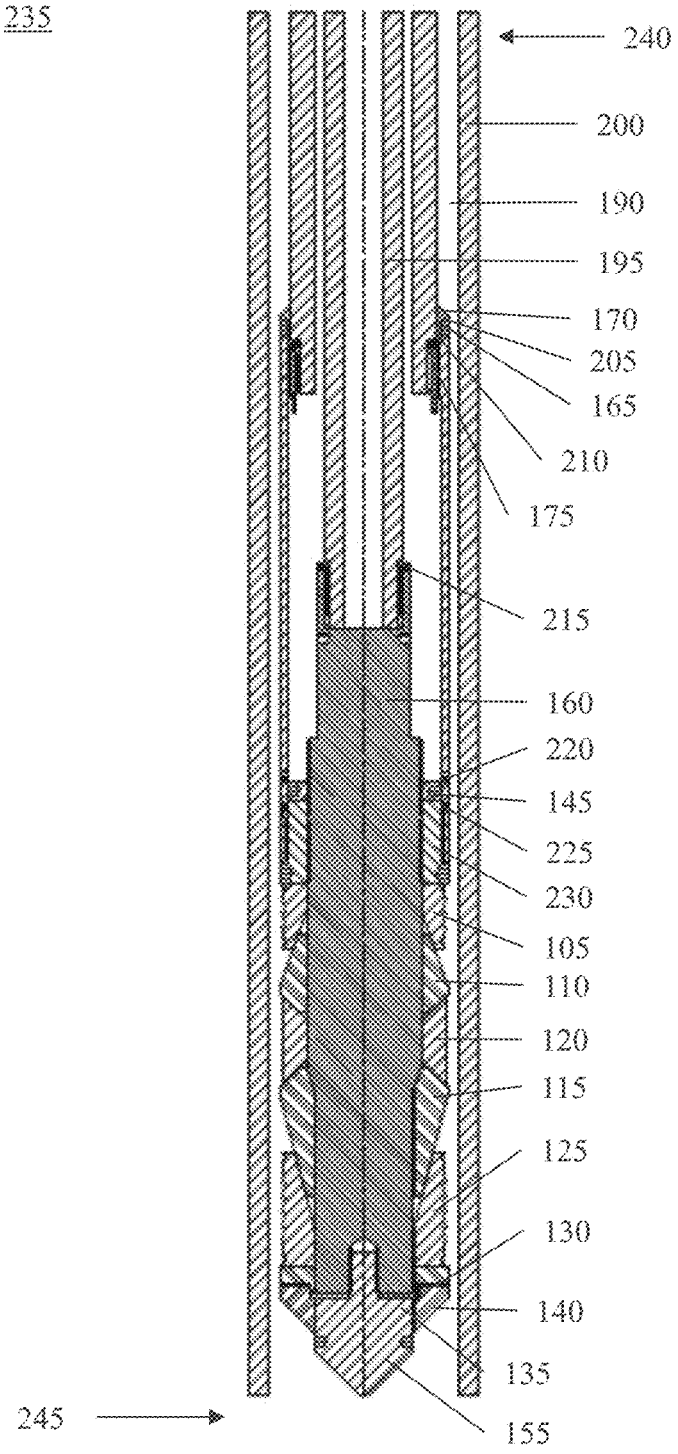
FIG. 27 shows a cross-sectional view of a bottom hole assembly in a well in accordance with one or more embodiments of the present invention.

Referring to FIG. 27, a cross-sectional view of a bottom hole assembly 235 according to embodiments of the present invention is shown. Bottom hole assembly 235 includes two separate components, a plug (100 of FIG. 1) and a setting tool (not independently numbered. For clarity, the components of the plug and the setting tool are provided in detail below.

The plug includes components that remain in the well after the plug is actuated. As such, the plug includes an upper slip 105, an upper cone 110, a packing element 120, a lower cone 115, a lower slip 125, a lower load ring 130, a shear mechanism 135, and a guide ring 140. Those of ordinary skill in the art will appreciate that in certain embodiment some components may be excluded or additional components added and still be within the scope of the present disclosure.

The setting tool includes components that are removed from the well after the plug is actuated. As such, the setting tool includes a WLAK guide ring 170, a WLAK mandrel 160, a WLAK adjuster nut 175, a WLAK setting sleeve 165, a WLAK lock nut 145, a WLAK upper load ring 150, and a WLAK nose 155. Those of ordinary skill in the art will appreciate that in certain embodiment some components may be excluded or additional components added and still be within the scope of the present disclosure.

Assembly of the bottom hole assembly 240 begins with the sub-assembly of the lower load ring 130, shear mechanism 135, and guide ring 140. Shear mechanism 135 is disposed between the lower load ring 130 and the guide ring 140 and the lower load ring 130, and guide ring 140 may be glued, threaded and screwed, snapped together, or otherwise mechanically attached. After this assembly, the lower cone 115 is installed from the bottom of the WLAK mandrel 160 such that the transition on the WLAK mandrel 160 from the larger upper outer diameter and the smaller lower outer diameter mates with the seat created on the inner diameter of the lower cone 115. The lower slip 125 is installed on the WLAK mandrel 160 such that the inner tapered surface of the lower slip 125 mates with the outer tapered surface of the lower cone 115.

The lower load ring 130, shear mechanism 135, and the guide ring 140, which is previously assembled, is installed on the WLAK mandrel 160 so that the shear mechanism 135 bottoms out on the bottom of the WLAK mandrel. The WLAK nose 155 is then run through the shear mechanism 135 and threads into the inner diameter threads on the WLAK mandrel 160. The WLAK nose 155 is then torqued to a desired setting to tighten the lower components so they do not move during run in.

The packing element 120 is then installed from the top of the WLAK mandrel 160, such that the outer tapered surface of the lower cone 115 mates with the inner tapered surface of the packing element 120. The upper cone 110 is then installed from above so that the outer tapered surface of the bottom of the upper cone 110 mates with the inner tapered surface of the top of the packing element 120. The upper slip 105 is then installed so that the inner tapered surface of the slip mates with the outer tapered surface of the upper cone 110. The WLAK upper load ring 150 is then installed against the top of the upper slip 105. The WLAK lock nut is installed from the top of the WLAK mandrel 160 and engages the threads 163 on the outer diameter of the WLAK mandrel 160. The WLAK lock nut 145 is tightened against the setting ring to a desired torque to prevent the components from moving during run in.

Prior to assembly onto the setting tool, the WLAK guide ring 170 and WLAK setting sleeve 165 are slid over the setting tool so that the WLAK setting sleeve is out of the way while installing the mandrel 160 and the plug assembly is threaded onto the setting tool.

The WLAK adjuster nut 175 is threaded on the setting tool cross link sleeve 190 and WLAK adjuster nut set screws 210 are installed to prevent the WLAK adjuster nut 175 from unthreading during operation. The WLAK mandrel 160 of the plug assembly is threaded into the setting tool mandrel 195 and WLAK mandrel set screws 215 are installed to prevent the WLAK mandrel 160 from unthreading during operation. The WLAK setting sleeve 165 is then threaded down to the outer diameter threads on the WLAK adjuster nut 175. The WLAK setting sleeve 165 will thread one thread onto the outer threads of the WLAK adjuster nut 175 before the inner threads on the distal end of the setting sleeve contact the outer threads on the WLAK upper load ring 230. When the WLAK setting sleeve 165 contacts the threads on the WLAK upper load ring 230, the WLAK upper load ring 230 is turned to engage the threads.

When the WLAK setting sleeve 165 is engaged with the threads of the WLAK adjuster nut 175 and the WLAK upper load ring 230, the setting shear screws are installed and then the WLAK setting sleeve 165 is fully threaded down onto the WLAK upper load ring 230, such that the WLAK setting sleeve shear screws 220 re located above the WLAK mechanical lock. The WLAK guide ring 170 is slid down on top of the WLAK setting sleeve 165, and the WLAK guide ring set screws 250 are screwed into place.

With the bottom hole assembly 235 assembled, the setting tool and plug may be lowered into a well to deliver the plug to a desired location.

Figure 28:
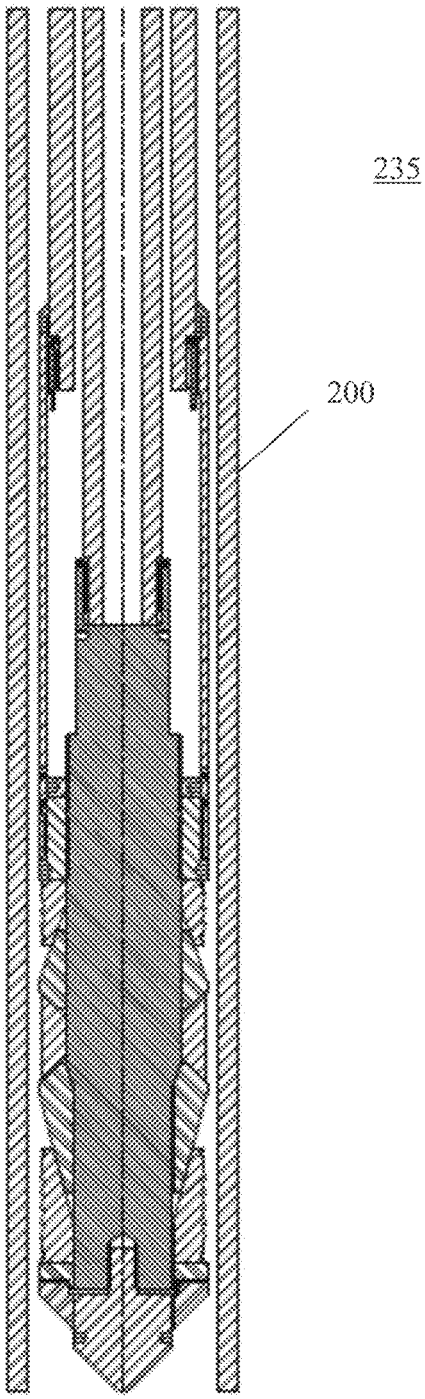
FIG. 28 shows a cross-sectional view of a bottom hole assembly in a well in accordance with one or more embodiments of the present invention.

Referring to FIG. 28 a cross-sectional view of a bottom hole assembly 235 in a well according to embodiments of the present invention is shown. In this embodiment, bottom hole assembly 235 is illustrated attached to a setting tool (FIGS. 25 and 26). The bottom hole assembly 235 include the components discussed in detail with respect to FIG. 27. At this stage of the operation to deliver a plug in a well, the bottom hole assembly 235 is fully connected and is being lowered into the well casing 200 of a well prior to setting the plug.

Figure 29:
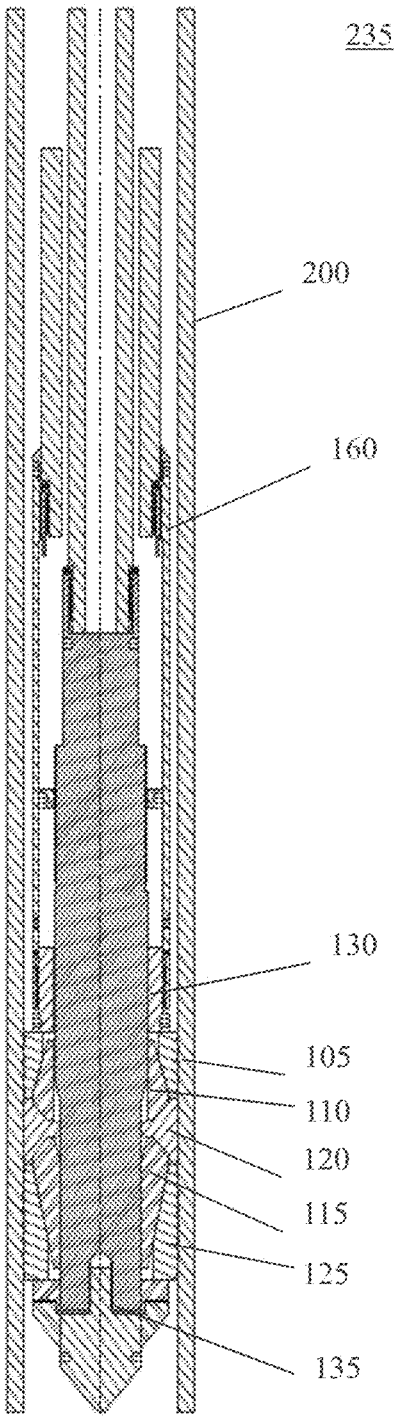
FIG. 29 shows a cross-sectional view of a bottom hole assembly in a well in accordance with one or more embodiments of the present invention.

Referring to FIG. 29, a cross-section view of a bottom hole assembly 235 in a well according to embodiments of the present invention is shown. FIG. 29 shows bottom hole assembly 235 in a well just prior to shearing on the shear mechanism thereby placing the plug in the well. In order to deliver the plug, the WLAK mandrel 160 remains static while the WLAK setting sleeve 165 presses down on all of the components on the mandrel through the WLAK upper load ring 230. The WLAK upper load ring 230 applies force to the top of the upper slip 105. The packing element 120 will ramp up the upper and lower cones 110/115 on the top and bottom of packing element 120 and engage well casing 200. As more force is loaded into the packing element 120, the packing element 120 will begin to extrude upwardly into the gap between the upper cone 110 and the inner diameter of the well casing 200. The packing element 120 will also extrude downwardly into the gap between the lower cone 115 and the inner diameter of the well casing 200, as well as inwardly into the gap between the upper and lower cones 110/115.

The force will also increase the load on the upper and lower slips 105/125 causing them to break and ramp up the respective upper and lower cones 110/115, thereby locking the upper and lower slips 105/125 into the casing.

At this point, the upper and lower slips 105/125 are locked into the casing and the packing element 120 has expanded, filling in the gaps between the upper and lower cones 110/115 and against the inner diameter of the well casing 200. When the packing element 120 is expanded into the desired state, the setting tool (FIGS. 25 and 26) may be separated, thereby leaving only the plug in the well. To separate the setting tool from the plug, after the upper and lower slips 105/125 are fully locked the force applied to the shear mechanism 135 will increase again, thereby reaching the sheare value causing shear mechanism 135 to shear or break. At this point, the setting tool is released from the plug, the plug remains in the well and the setting tool may be returned to the surface for removal.

After shearing the shear mechanism 135, the WLAK mandrel 160 will separate from the plug components. Prior to shearing the shear mechanism 135, the packing element 120 will have moved down into the portion of the mandrel that has the smallest outer diameter. As such, the inward extrusion of the packing element 120 will not interfere with the removal of the WLAK mandrel 160.

Figure 30:
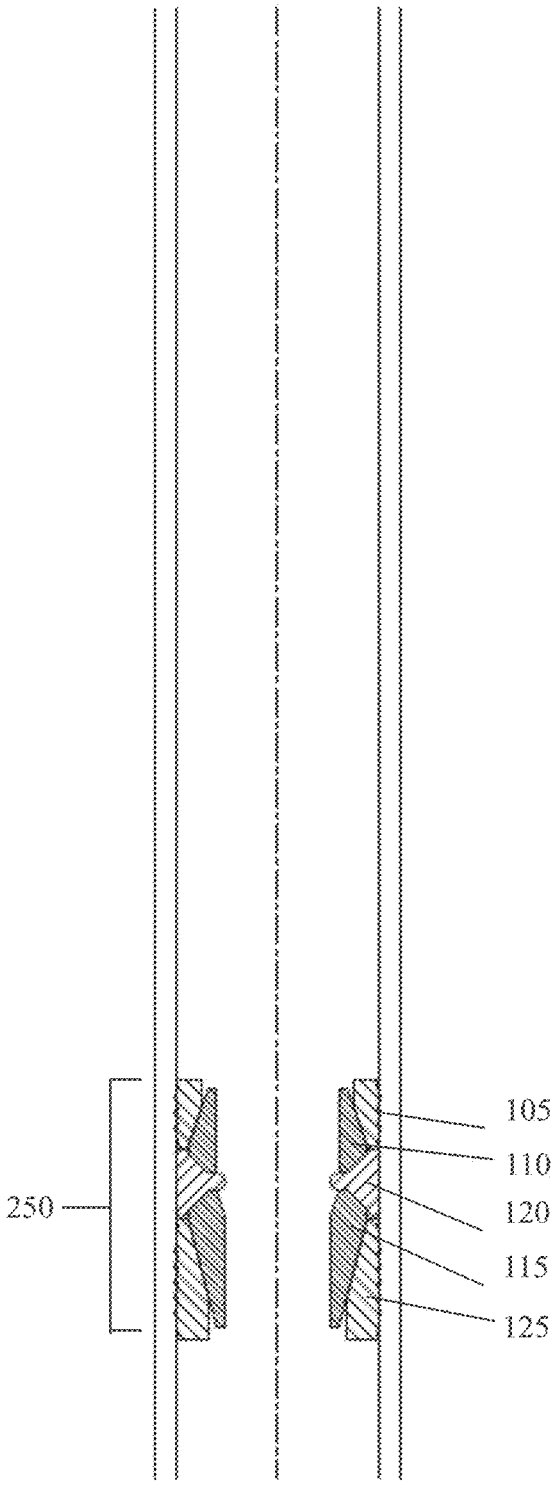
FIG. 30 shows a cross-sectional view of a plug assembly in a well in accordance with one or more embodiments of the present invention.

Referring to FIG. 30, a cross-section view of a plug assembly 250 according to embodiments of the present invention is shown. To further clarify the components that remain in the well after the setting tool is separated from the plug assembly, only the plug assembly 250 components are illustrated in FIG. 30. Components of the plug assembly include the upper slip 105, the upper cone 110, the packing element 120, the lower cone 115, and the lower slip 125.

Prior to separation from the setting tool, plug assembly 250 further included the shear mechanism (135 of FIG. 29), the lower load ring (130 of FIG. 1), and the guide ring (140 of FIG. 1). After the shear mechanism (135 of FIG. 29) was sheared off it fell down into the well and is no longer part of the plug assembly 250. Similarly, the lower load ring (130 of FIG. 1) and the guide ring (140 of FIG. 1) also were removed from the plug assembly 250 after the shear mechanism (135 of FIG. 29) was sheared free.

At this point, the plug assembly 250 is set within the well and is in condition to receive a ball (not shown) in order to fully isolate sections of the well.

Figure 31:
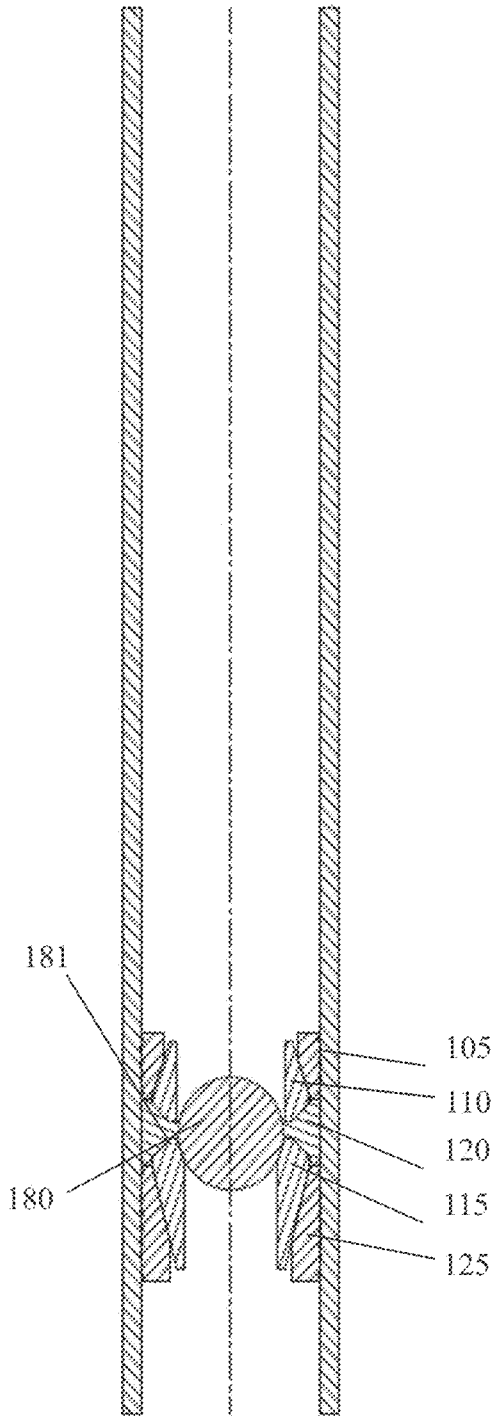
FIG. 31 shows a cross-sectional view of a plug assembly with a ball in a well in accordance with one or more embodiments of the present invention.

Referring to FIG. 31, a cross-sectional view of a well according to embodiments of the present invention is shown. After the setting tool components are removed from the well, a ball 180 may be dropped from the surface. Ball 180 will descend within the well until it lands on a ball seat 181 created by the inner diameter of lower cone 115. As explained above, the inner diameter of lower cone 115 includes a tapered conical shape on the proximate 118 inner diameter that effectively creates the seat, or landing area, for the ball 180 to land.

In certain embodiments, the packing element 120 may not have fully extruded through the gap between upper and lower cones 110/115. In such a situation, integrity of the seal is maintained due to the ball 180 sitting in the ball seat 181 created by the shape of lower cone 115. However, in other embodiments, packing element 120 may have extruded through the gap between upper and lower cones 110/115. In such an embodiment, the upper and lower cones 110/115 will be insulated from hydraulic pressure that may otherwise damage the components because the seal will be created by the contact between the ball 180 and packing element 120. In such an embodiment, the seat 181 created by the lower cone 115 may serve as a redundant sealing mechanism should the packing element 120 lose extrusion and retract into the gap between the upper and lower cones 110/115.

Figure 32:
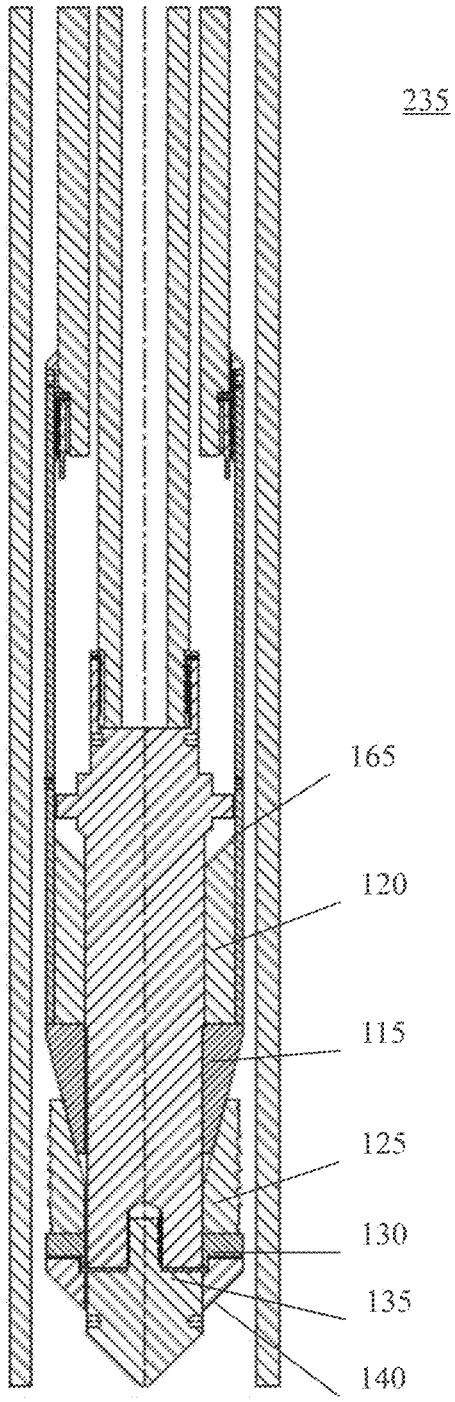
FIG. 32 shows a cross-sectional view of a bottom hole assembly in a well in accordance with one or more embodiments of the present invention.

Referring to FIG. 32, a cross-sectional view of a bottom hole assembly 235 in a well according to embodiments of the present invention is shown. In this embodiment, bottom hole assembly 235 is similar to the bottom hole assembly 235 described above, however, several components have been omitted to simply the ultimate design of the plug that remains in the well. In this embodiment, bottom hole assembly retains the setting tool components identified in detail with respect to FIG. 27, however, the components of the plug are different. In this embodiment, the plug assembly (not independently illustrated) includes a packing element 120, a lower cone 115, a lower slip 125, a lower load ring 130, a shear mechanism 135, and a guide ring 140. During run in, the packing element 120 is disposed substantially or completely within the WLAK setting sleeve 165, thereby protecting the packing element while the bottom hole assembly 235 is disposed in the well.

Figure 33:
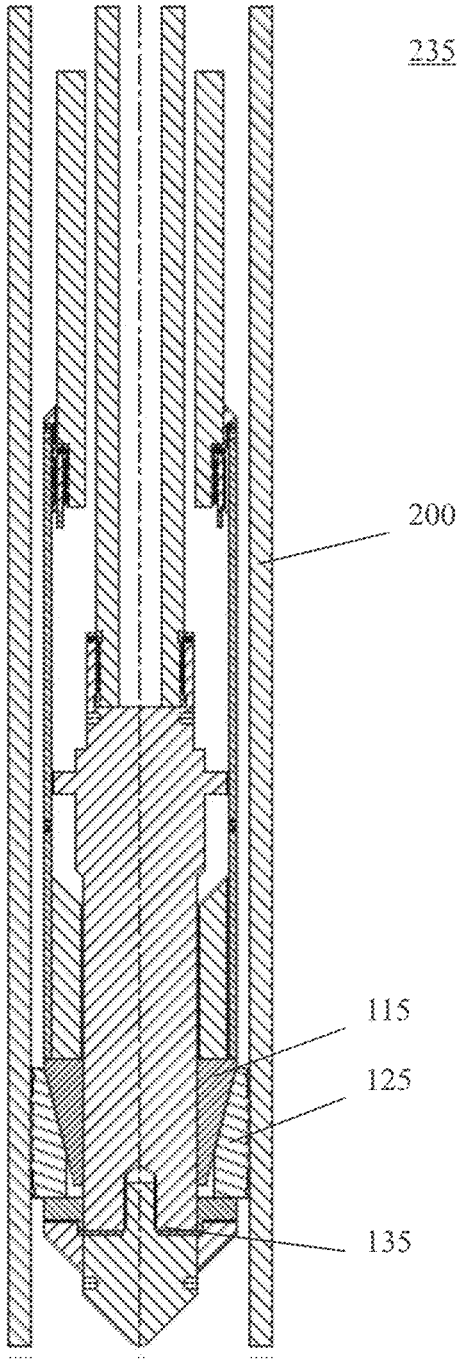
FIG. 33 shows a cross-sectional view of a bottom hole assembly in a well in accordance with one or more embodiments of the present invention.

Referring to FIG. 33, a cross-sectional view of a bottom hole assembly 235 in a well according to embodiments of the present invention is shown. FIG. 33 shows bottom hole assembly 235 in a well just prior to shearing on the shear mechanism thereby placing the plug in the well. The force applied by the setting tool (FIGS. 25 and 26) has forced the lower cone 115 downward into contact with lower slip 125 thereby causing lower slip 125 to engage the well casing 200. As lower slip 125 engages well casing 200, the lower slip 125 is locked into place. As the pressure continues to be applied by the setting tool, the shear mechanism 135 will shear when a specified shear force is applied, thereby disconnecting the plug assembly components from the setting tool components. The setting tool may then be returned to the surface for removal from the well, while the plug assembly components may remain in the well.

Figure 34:
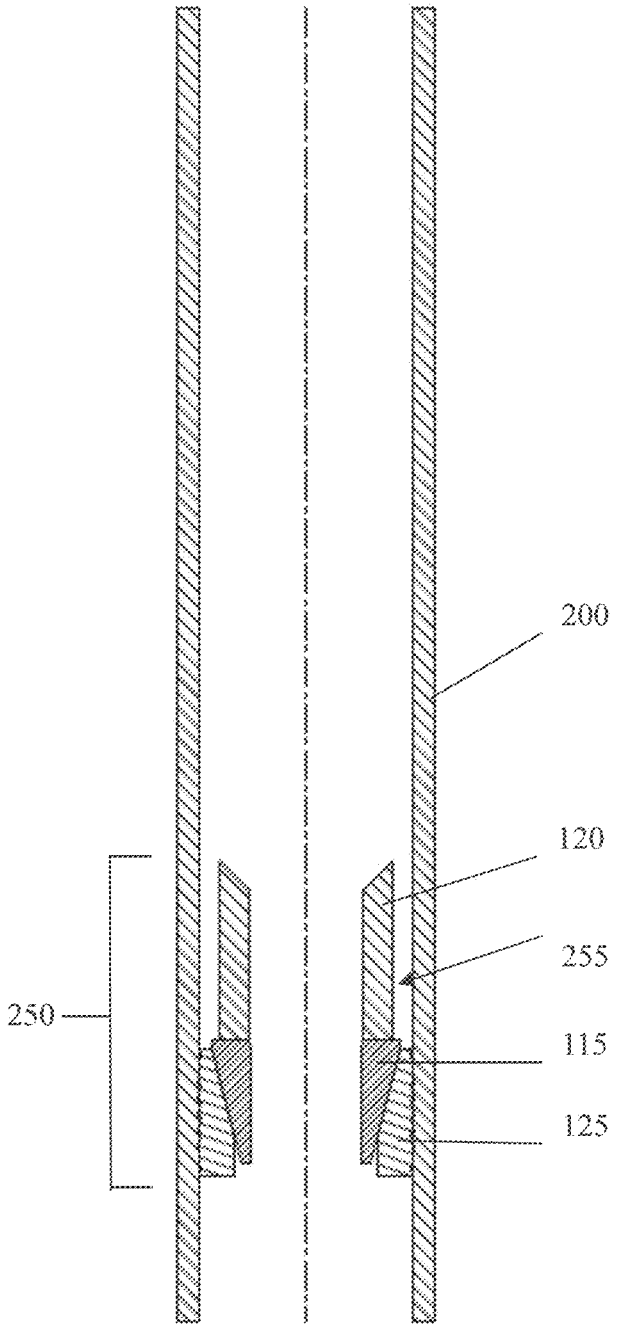
FIG. 34 shows a cross-sectional view of a plug assembly in a well in accordance with one or more embodiments of the present invention.

Referring to FIG. 34, a cross-sectional view of a plug assembly 250 according to embodiments of the present invention is shown. To further clarify the components that remain in the well after the setting tool is separated from the plug assembly 250, only the plug assembly 250 components are illustrated in FIG. 34. Components of the plug assembly include the packing element 120, the lower cone 115, and the lower slip 125. Unlike in the prior embodiments, in this embodiment the seal is spaced away from the internal diameter of the casing, thereby creating a packing element annulus 255 between the packing element 120 and the well casing 200.

Prior to separation from the setting tool, plug assembly 250 further included the shear mechanism (135 of FIG. 29), the lower load ring (130 of FIG. 1), and the guide ring (140 of FIG. 1). After the shear mechanism (135 of FIG. 29) was sheared off it fell down into the well and is no longer part of the plug assembly 250. Similarly, the lower load ring (130 of FIG. 1) and the guide ring (140 of FIG. 1) also were removed from the plug assembly 250 after the shear mechanism (135 of FIG. 29) was sheared free.

At this point, the plug assembly 250 is set within the well and is in condition to receive a ball (not shown) in order to fully isolate sections of the well.

Figure 35:
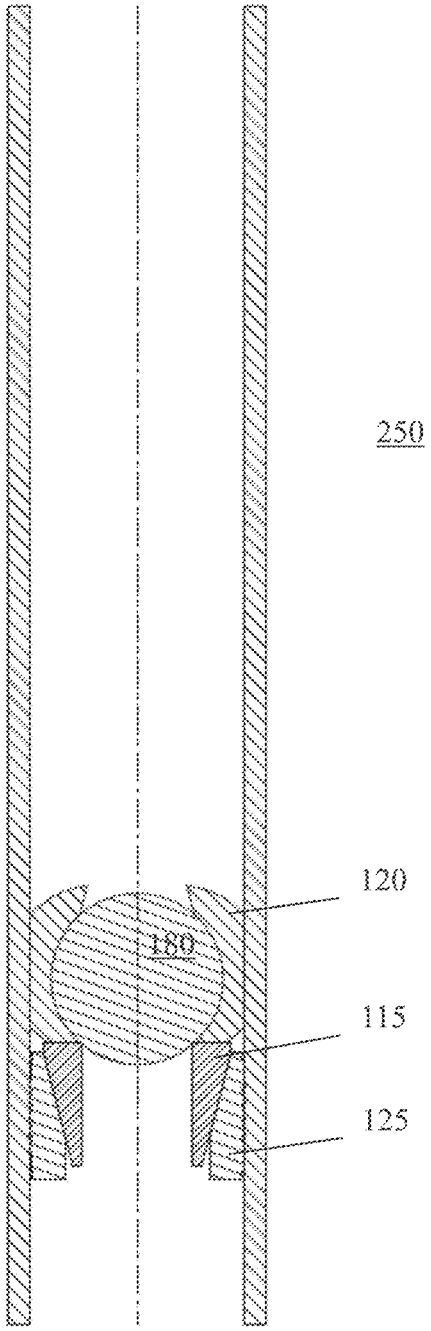
FIG. 35 shows a cross-sectional view of a plug assembly with a ball in a well in accordance with one or more embodiments of the present invention.

Referring to FIG. 35, a cross-sectional view of a plug assembly 250 with a ball 180 according to embodiments of the present invention is shown. As illustrated, plug assembly 250 includes the packing element 120, the lower cone 115, and the lower slip 125. As the ball 180 descends from the surface of the well, the ball 180 falls into contact with the packing element 120. The ball 180 lands on lower cone 115, which forms a lower cone shoulder 260, thereby preventing the ball 180 from passing through. In certain embodiments the ball 180 may directly contact lower cone 115, while in other embodiments, packing element 120 may extend around the ball 115 to partially or completely prevent ball 180 from directly contacting lower cone 115. Thus, a seal may be created between the ball 180 and lower cone 115, the ball 180, lower cone 115, and packing element 120, or between ball 180 and packing element 130. In certain embodiments, packing element 120 may substantially surround ball 180, while in other embodiments only a portion of packing element 120 may extrude around ball 180. Those of ordinary skill in the art will appreciate that the size of ball 180 and the length and thickness of packing element 120 may be adjusted to achieve certain sealing dynamics.

Figure 36:
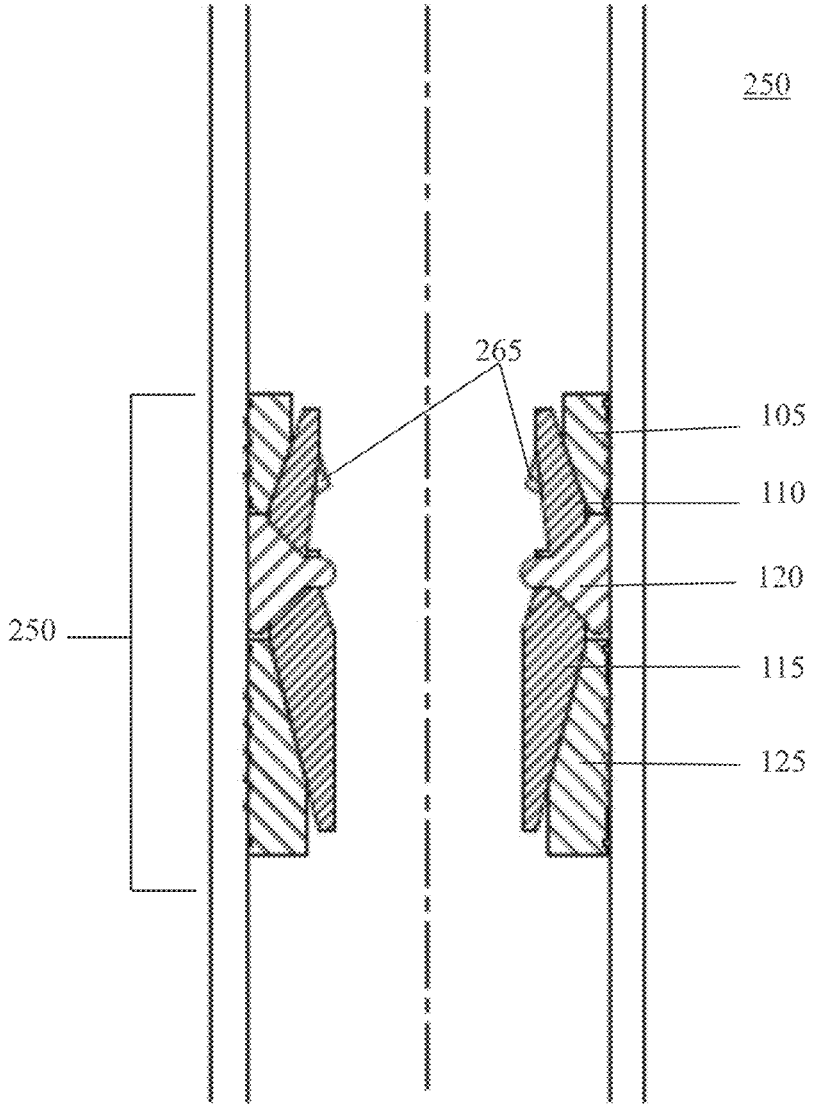
FIG. 36 shows a cross-sectional view of a plug assembly in a well in accordance with one or more embodiments of the present invention.

Referring to FIG. 36, a cross-sectional view of a plug assembly 250 according to embodiments of the present invention is shown. In this embodiment, plug assembly 250 is disposed in a well. The plug assembly includes an upper slip 105, and upper cone 110, a packing element 120, a lower cone 115, and a lower slip 125. Packing element 120 has extruded beyond the inner diameter of upper cone 110. Upper cone 110 also includes a mechanical lock 265 disposed on the inner diameter thereof, illustrated in a relaxed position. Mechanical lock 265 expands radially from the inner diameter of upper cone 110 away from the center of the well. Mechanical lock 265 may be manufactured or formed from various materials including metal, metal alloys, composites, elastomeric materials, combinations of the above and the like.

Figure 37:
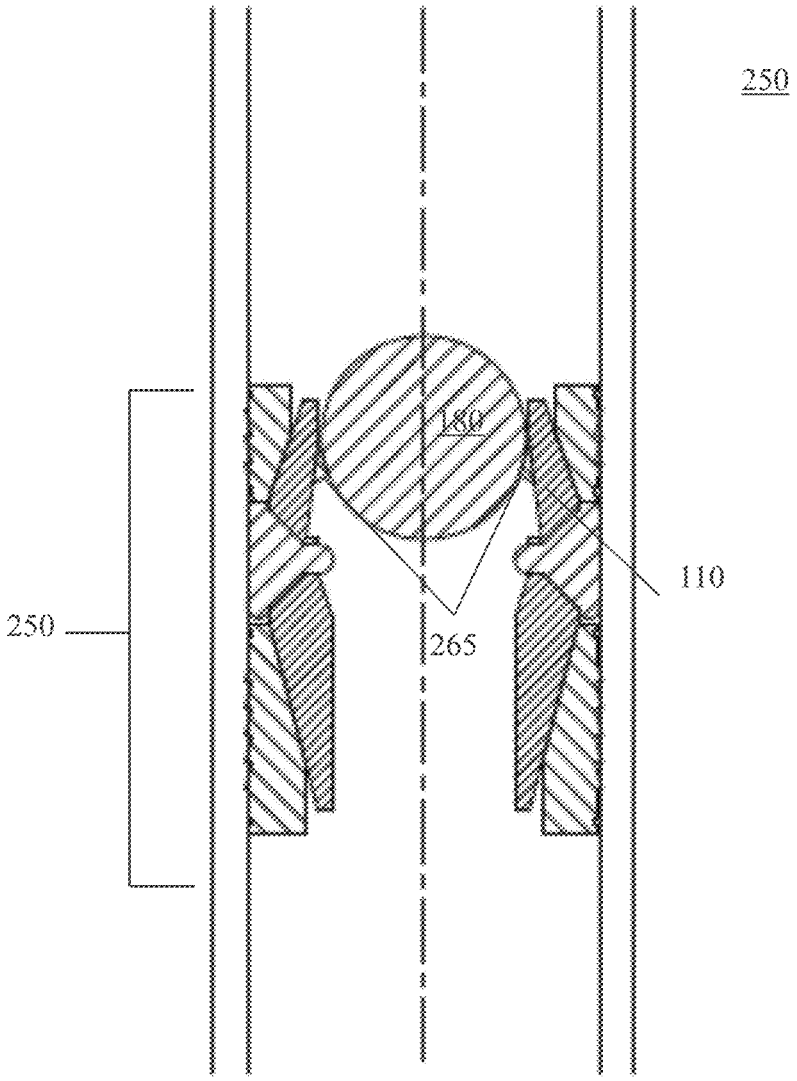
FIG. 37 shows a cross-sectional view of a plug assembly with a ball in a well in accordance with one or more embodiments of the present invention.

Referring to FIG. 37, a cross-sectional view of a plug according to embodiments of the present invention is shown. In this embodiment plug assembly 250 is set in the well and a ball 180 is in the process of passing through the upper cone 110 and lands on mechanical lock 265. At this point, ball 180 is not in contact with packing element 120 and is beginning to force mechanical lock 265 radially outward away from the center of the well and toward upper cone 110.

Figure 38:
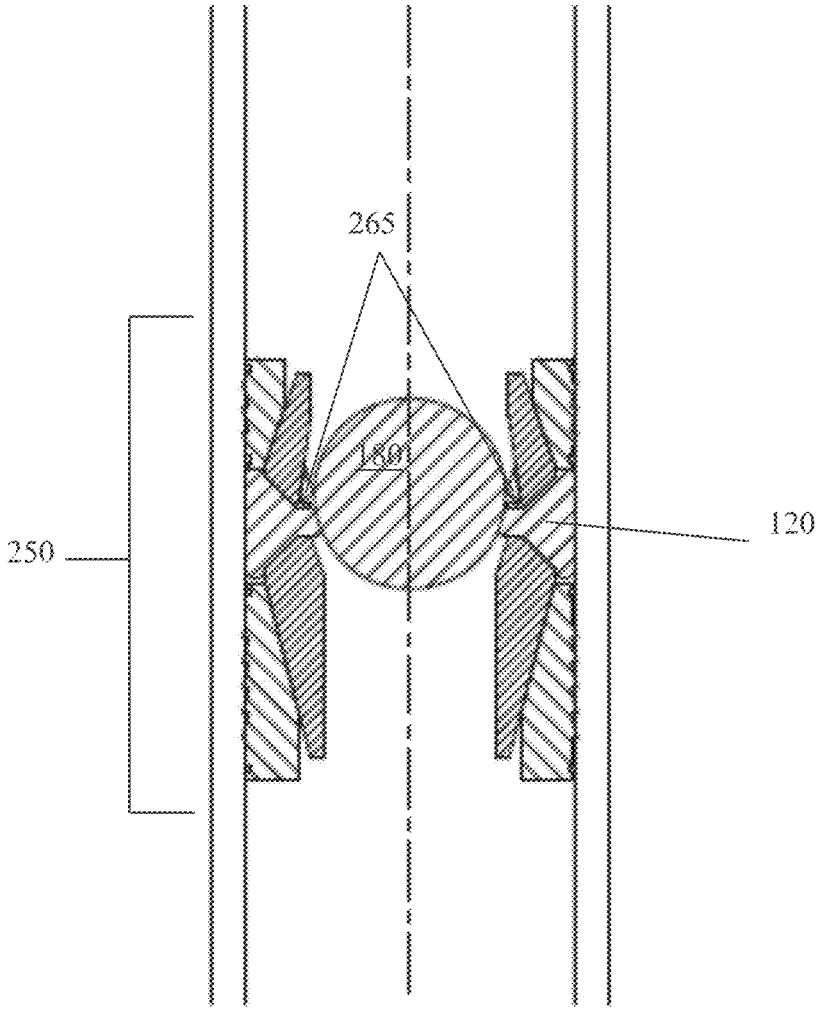
FIG. 38 shows a cross-sectional view of a plug assembly with a ball in a well in accordance with one or more embodiments of the present invention.

Referring to FIG. 38, a cross-sectional view of a plug according to embodiments of the present invention is shown. In this embodiment, plug assembly 250 is set in the well and ball 180 is in the process of passing through mechanical lock 265. Mechanical lock 265 is being forced radially outward and ball 180 is beginning to deform packing element 120, thereby creating a temporary seal.

Figure 39:
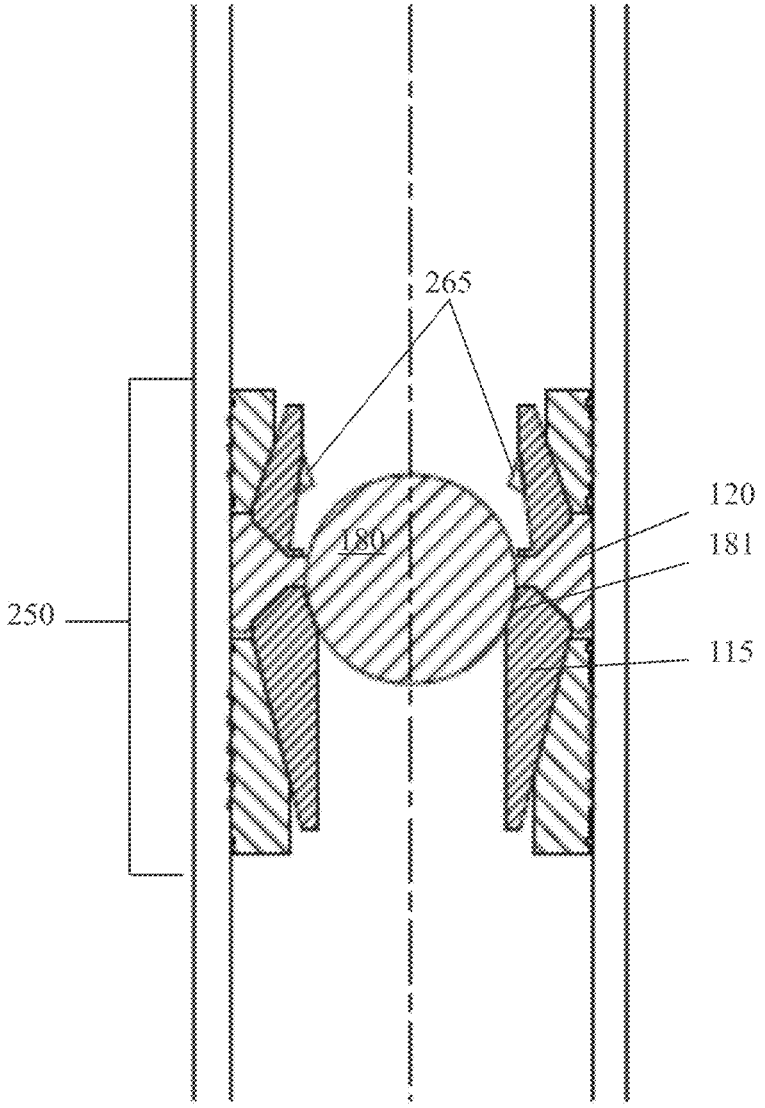
FIG. 39 shows a cross-sectional view of a plug assembly with a ball in a well in accordance with one or more embodiments of the present invention.

Referring to FIG. 39, a cross-sectional view of a plug according to embodiments of the present invention is shown. In this embodiment, plug assembly 250 is set in the well and ball 180 has passed through mechanical lock 265 and is disposed against lower cone 115. The lock rink 265 has returned to a relaxed, un-expanded form, thereby returning to a position radially inwardly toward the center of the well. Ball 180 is now seated on ball seat 181 of lower cone 115 and is created a seal therebetween.

Figure 40:
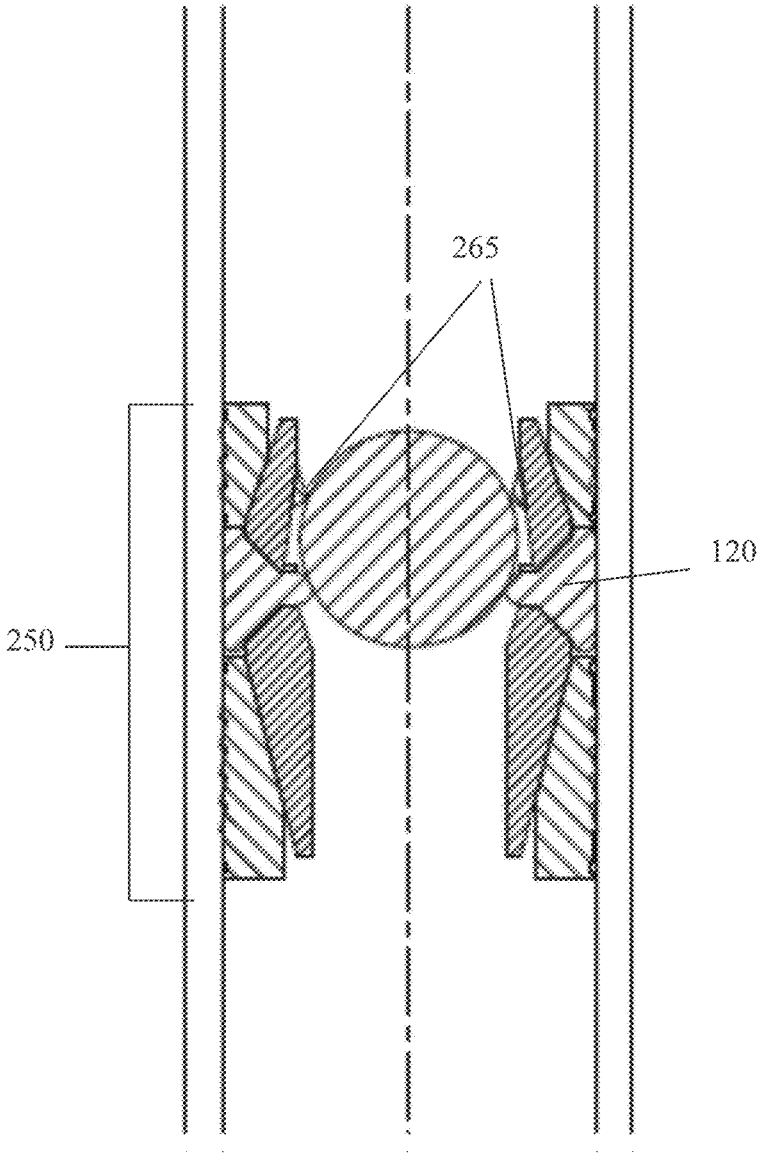
FIG. 40 shows a cross-sectional view of a plug assembly with a ball in a well in accordance with one or more embodiments of the present invention.

Referring to FIG. 40, a cross-sectional view of a plug according to embodiments of the present invention is shown. In this embodiment, plug assembly 250 is set in the well and ball 180 had previously been seated against ball seat 181 (FIG. 39). When pressure occurs from below ball 180, the ball 180 may shift upwardly and contact the mechanical lock 265. The mechanical lock 265 then prevents ball 180 from traversing upward of the mechanical lock 265 and the mechanical lock 265 thereby creates a seal between mechanical lock 265 and ball 180 and/or ball 180 and packing element 120. Accordingly, when such a plug is used as a bridge plug, and pressure is increased from a lower section of a well, a seal may still be maintained do to the mechanical lock 265 preventing the ball 180 from moving out of the plug assembly 250.

Advantages of one or more embodiments of the present invention may include one or more of the following:

In one or more embodiments of the present invention, a bottom hole assembly providing a frac or bridge plug having fewer components may be provided by moving components conventionally on the plug to the setting tool. By removing certain components to the setting tool, well treatment operations may cost less, take less time, and be more efficient.

In one or more embodiments of the present invention, a frac or bridge plug that providing a packing element that extrudes inwardly into the inner diameter of the well, thereby allow a ball to seal against the packing element.

In one or more embodiments of the present invention, a frac or bridge plug providing a ball that seals against a seal seat of the lower cone. The ball passes through an upper cone having a larger inner diameter than the lower cone and then seats directly against the lower cone.

In one or more embodiments of the present invention, a bottom hole assembly providing a shear mechanism as a shearing mechanism to separate a setting tool from a plug. Because the shear mechanism is relatively small, less material is left in the well, thereby increasing treatment efficiency.

In one or more embodiments of the present invention, a frac or bridge plug providing a structure that does not have a mandrel. Because the plug does not include a mandrel, drill out operations may be faster and more efficient.

In one or more embodiments of the present invention, a frac or bridge plug providing a sealing mechanism that only requires a lower slip, a lower cone, a packing element, and a ball. Because the packing element extends into the inner diameter of the well, when the ball contacts the packing element, the packing element is energized by the ball and seals against the inner diameter of the well. By removing components from the plug, the operation thereby becomes less expensive.

In one or more embodiments of the present invention, a plug providing a lower load ring that falls away after setting. Because the lower load ring does not remain attached to the plug, milling operations may be faster and more efficient.

In one or more embodiments of the present invention, a bottom hole assembly providing wherein the packing element remains under the setting sleeve during run in, thereby protecting the sealing element from potential hazards in the well.

In one or more embodiments of the present invention, a plug provides a mechanical lock that restricts a ball from flowing axially upward once landed on the seat. The seal is maintained because the ball remains engaged with the packing element. Such a design provides the benefits of a frac plug and a bridge plug, but eliminates the risks associated with using a bridge plug configuration.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. A bottom hole assembly comprising:

a plug comprising:

a packing element, a lower cone disposed below the packing element, a lower slip disposed below the lower cone, an upper cone disposed above the packing element, wherein the upper cone has a larger inner diameter than the lower cone, and an upper slip disposed above the upper cone;

a setting tool removably attached to the plug, the setting tool comprising:

a mandrel, and a setting sleeve;

a lower load ring disposed on the plug;

a shear mechanism disposed on the plug; and a guide ring disposed on the mandrel.

2. The bottom hole assembly of claim 1, further comprising a mechanical lock disposed on the inner diameter of the upper cone.

3. The bottom hole assembly of claim 1, wherein the lower cone comprises a tapered conical shape on a proximate end forming a ball seat.

4. A plug comprising:

a packing element;

a lower cone disposed below the packing element, the lower cone having a tapered conical shape on a proximate end forming a ball seat;

an upper cone disposed above the packing element, the upper cone having a larger inner diameter than the lower cone;

a lower slip disposed below the lower cone;

an upper slip disposed above the upper cone; and a ball disposed in the ball seat, wherein the packing element deforms on the ball.

5. The plug of claim 4, further comprising a mechanical lock disposed on an inner diameter of the upper cone.

6. The plug of claim 5, wherein the mechanical lock is configured to prevent upward movement of the ball.

7. The plug of claim 4, wherein the ball contacts the packing element.

8. A method for sealing a section of a well, the method comprising:

disposing, in a well, a bottom hole assembly comprising a plug and a removable setting tool, wherein the plug comprises a packing element, a lower cone, a lower slip, an upper cone having an inner diameter larger than the lower cone, an upper slip, and a shear mechanism and the removable setting tool comprises a mandrel and a setting sleeve;

applying pressure to the setting sleeve;

contacting an inner diameter of the well with the upper slip, packing element, and lower slip as a result of the applying pressure;

locking the upper and lower slip against the inner diameter of the well;

shearing the shear mechanism;

disconnecting the removable setting tool from the plug;

removing the removable setting tool from the well;

dropping a ball into the well;

deforming the packing element on the ball;

contacting the ball with a ball seat; and separating the well into at least two sections.

9. The method of claim 8, further comprising sealing the packing element against the well, and extruding the packing element into a gap between the upper cone and the lower cone.

10. The method of claim 9, wherein the extruding comprises extruding the packing element inward toward the inner diameter of the plug.

11. The method of claim 8, further comprising passing the ball through a mechanical lock disposed on the upper cone.

12. The method of claim 11, further comprising preventing the ball from flowing axially upward of the mechanical lock.

13. The method of claim 12, wherein the preventing further comprises maintaining contact between the ball and the packing element and maintaining the separating the well into at least two sections.

14. The method of claim 8, further comprising landing the ball on the ball seat formed by a tapered conical shape on a proximate end of the lower cone.

15. The method of claim 8, further comprising maintaining a seal between the packing element and a well wall, wherein the maintaining separates the well into the at least two sections.

16. The method of claim 8, wherein the contacting the ball with the ball seat comprises compressing the packing element and preventing the ball from contacting the lower cone.

17. The method of claim 8, wherein the bottom hole assembly further comprises a setting mandrel, wherein the setting mandrel is configured to provide inward extrusion of the packing element and limit the packing element extrusion to maintain a seal on a well wall.

* * * * *